US011568780B2

(12) United States Patent
Akiba

(10) Patent No.: US 11,568,780 B2
(45) Date of Patent: Jan. 31, 2023

(54) IMAGE DIVIDING CIRCUIT AND ELECTRO-OPTICAL APPARATUS

(71) Applicant: Seiko Epson Corporation, Tokyo (JP)

(72) Inventor: Yasutoshi Akiba, Chino (JP)

(73) Assignee: SEIKO EPSON CORPORATION

( * ) Notice: Subject to any disclaimer, the term of this patent is extended or adjusted under 35 U.S.C. 154(b) by 0 days.

(21) Appl. No.: 17/534,583

(22) Filed: Nov. 24, 2021

(65) Prior Publication Data

US 2022/0165194 A1 May 26, 2022

(30) Foreign Application Priority Data

Nov. 26, 2020 (JP) ..... JP2020-195825

(51) Int. Cl.
*G09G 3/20* (2006.01)

(52) U.S. Cl.
CPC ..... *G09G 3/20* (2013.01); *G09G 2310/0224* (2013.01); *G09G 2310/061* (2013.01); *G09G 2310/08* (2013.01); *G09G 2340/0435* (2013.01)

(58) Field of Classification Search
None
See application file for complete search history.

(56) References Cited

U.S. PATENT DOCUMENTS

| | | | |
|---|---|---|---|
| 5,663,765 A | 9/1997 | Matsuse et al. | |
| 2002/0180746 A1 | 12/2002 | Yasui | |
| 2006/0061601 A1 | 3/2006 | Iga et al. | |
| 2017/0186359 A1* | 6/2017 | Lee | G09G 3/2074 |

FOREIGN PATENT DOCUMENTS

| | | |
|---|---|---|
| JP | H08-123367 A | 5/1996 |
| JP | H10-111669 A | 4/1998 |
| JP | 2001-083927 A | 3/2001 |
| JP | 2001-166733 A | 6/2001 |
| JP | 2001-184038 A | 7/2001 |
| JP | 2005-025076 A | 1/2005 |
| JP | 2006-085021 A | 3/2006 |

* cited by examiner

*Primary Examiner* — Christopher J Kohlman
(74) *Attorney, Agent, or Firm* — Harness, Dickey & Pierce, P.L.C.

(57) ABSTRACT

An image dividing circuit includes an input interface circuit that receives input image data configured by a total number of horizontal pixels HT, an image data dividing circuit that divides the input image data into first to n-th output image data, and an output interface circuit that includes output circuits for first to n-th channels that output the first to n-th output image data. The parameter n is an integer greater than or equal to 3, and the parameter HT is not an integer multiple of the parameter n. An output circuit for an i-th channel outputs i-th output image data in which at least one of the total number of horizontal pixels and the total number of vertical lines in the i-th channel has been variably adjusted. The parameter i is an integer greater than or equal to 1 but smaller than or equal to n.

14 Claims, 16 Drawing Sheets

IMAGE DIVIDING CIRCUIT AND ELECTRO-OPTICAL APPARATUS

The present application is based on, and claims priority from JP Application Serial Number 2020-195825, filed Nov. 26, 2020, the disclosure of which is hereby incorporated by reference herein in its entirety.

BACKGROUND

1. Technical Field

The present disclosure relates to an image dividing circuit, an electro-optical apparatus, and the like.

2. Related Art

JP-A-2001-83927 discloses a method for driving a display apparatus. The driving method includes receiving a digital video signal, a panel enable signal, a dot clock signal, and a horizontal sync signal, detecting the horizontal resolution by using the panel enable signal and the dot clock signal, detecting the vertical resolution by using the panel enable signal and the horizontal sync signal, and performing optimal video processing based on the detected horizontal resolution and vertical resolution.

For example, when an electro-optical panel has a high horizontal resolution, there is a method for driving the electro-optical panel with two display drivers. In the method, input image data is divided into two output image data corresponding to the two display drivers. Since the total number of horizontal pixels in the input image data is typically a multiple of two, one half of the total number of horizontal pixels in the input image data is the total number of horizontal pixels in each of the output image data.

For example, when the horizontal resolution of the electro-optical panel is higher, it is conceivable to employ a method for driving the electro-optical panel with n display drivers, n being three or greater. When the total number of horizontal pixels in the input image data is not a multiple of n, however, the total number of horizontal pixels in each of the output image data cannot be 1/n of the total number of horizontal pixels in the input image data. In this case, the length of the horizontal scanning period differs between the input image data and the output image data, which means that the length of one frame also differs therebetween, so that the frame rates on the input and output sides do not synchronize with each other, resulting in a problem of display errors.

SUMMARY

An aspect of the present disclosure relates to an image dividing circuit including an input interface circuit that receives input image data configured by a total number of horizontal pixels HT and a total number of vertical lines VT, an image data dividing circuit that divides the input image data into first to n-th output image data for first to n-th channels, and an output interface circuit that includes output circuits for first to n-th channels that output the first to n-th output image data. The parameter n is an integer greater than or equal to 3, and the parameter HT is not an integer multiple of the parameter n. An output circuit for an i-th channel (i is an integer greater than or equal to 1 but smaller than or equal to n) out of the output circuits for first to n-th channels outputs, out of the first to n-th output image data, i-th output image data in which at least one of the total number of horizontal pixels and the total number of vertical lines in the i-th channel out of the first to n-th channels is variably adjusted.

Another aspect of the present disclosure relates to an electro-optical apparatus including the image dividing circuit described above, an electro-optical panel, and first to n-th display drivers that drive the electro-optical panel based on the first to n-th output image data outputted by the image dividing circuit.

DESCRIPTION OF EXEMPLARY EMBODIMENTS

A preferable embodiment of the present disclosure will be described below in detail. It is not intended that the present embodiment described below unduly limits the contents described in the claims, and all configurations described in the present embodiment are not necessarily essential configuration requirements.

1. Image Dividing Circuit, Electro-Optical Apparatus, and Display System

Figure 1:
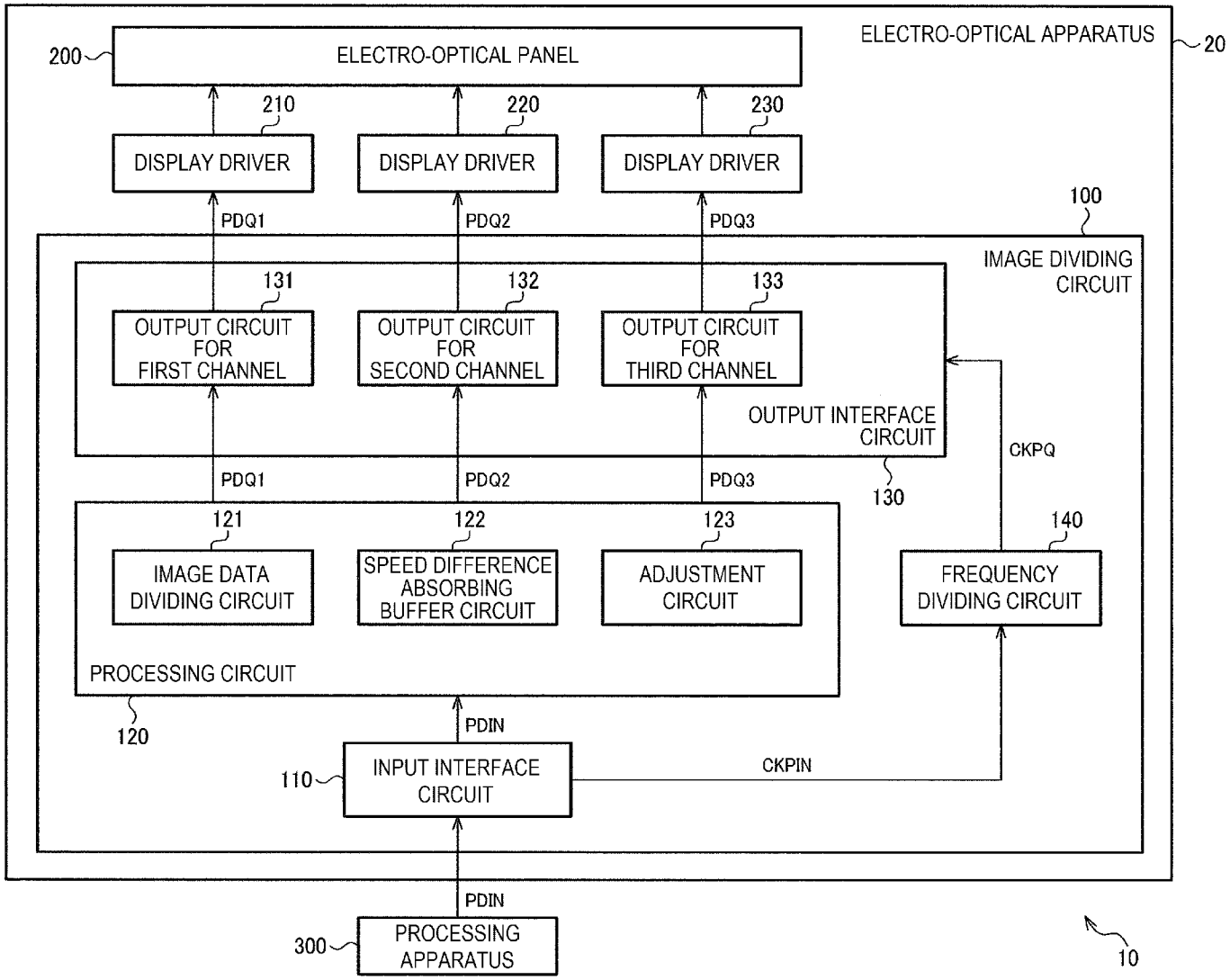
FIG. 1 shows an example of the configurations of an image dividing circuit, an electro-optical apparatus, and a display system.

FIG. 1 shows an example of the configurations of an image dividing circuit 100, an electro-optical apparatus 20, and a display system 10. The display system 10 includes a processing apparatus 300 and the electro-optical apparatus 20. The electro-optical apparatus 20 includes the image dividing circuit 100, display drivers 210, 220, and 230, and an electro-optical panel 200. In FIG. 1, the description will be made of a case where the three display drivers 210, 220, and 230 drive the electro-optical panel 200, and first to n-th display drivers may instead drive the electro-optical panel 200. The parameter n is an integer greater than or equal to three.

The electro-optical panel 200 is a display panel in which a pixel array in the form of a two-dimensional matrix is disposed, and images are displayed on the pixel array, for example, by controlling the light transmission or light emission at each pixel. The electro-optical display panel 200 is, for example, a liquid crystal display panel or an EL display panel. EL is an abbreviation for electro luminescence.

The display drivers 210, 220, and 230 drive the electro-optical panel 200 based on image data and timing control signals received from the image dividing circuit 100. The timing control signals vary in accordance with the image interface standard and are, for example, each formed of a vertical sync signal, a horizontal sync signal, and a pixel clock signal. The display drivers 210, 220, and 230 are each an integrated circuit device in which circuit elements are integrated on a semiconductor substrate. The display drivers 210, 220, and 230 each have a built-in display controller, and circuits relating to the driver and circuits relating to the display controller are integrated into a single integrated circuit device. The circuits relating to the driver and the circuits relating to the display controller may be configured as separate integrated circuit devices. Instead, the image dividing circuit 100 and the circuits relating to the display controller may be integrated into a single integrated circuit device.

The processing apparatus 300 transmits image data and a timing control signal to the image dividing circuit 100. The timing control signal varies in accordance with the image interface standard and is, for example, formed of a vertical sync signal, a horizontal sync signal, and a pixel clock signal. The processing apparatus 300 is, for example, an SoC or an ECU and may be formed of a processor, such as a CPU, or a processing module in which a plurality of circuit parts are mounted on a circuit substrate. SoC is an abbreviation for a system on chip, ECU is an abbreviation for electronic control unit, and CPU is an abbreviation for central processing unit.

The image dividing circuit 100 divides input image data PDIN received from the processing apparatus 300 into three output image data PDQ1 to PDQ3 and transmits the output image data PDQ1 to the display driver 210, the output image data PDQ2 to the display driver 220, and the output image data PDQ3 to the display driver 230. When the first to n-th display drivers are provided, the image dividing circuit 100 divides the input image data PDIN into n output image data, first to n-th output image data.

The image dividing circuit 100 includes an input interface circuit 110, a processing circuit 120, an output interface circuit 130, and a frequency dividing circuit 140. The image dividing circuit 100 is an integrated circuit device in which circuit elements are integrated on a semiconductor substrate.

The input interface circuit 110 receives an image interface signal transmitted from the processing apparatus 300 and acquires the input image data PDIN and the timing control signal from the received image interface signal. For example, when the timing control signal is formed of a vertical sync signal, a horizontal sync signal, and a pixel clock signal, the input image data PDIN, the vertical sync signal, the horizontal sync signal, and the pixel clock signal may be transmitted along respective dedicated signal lines. In this case, the input interface circuit 110 acquires the input image data PDIN and the signals transmitted along the dedicated signal lines. Instead, part or all of the vertical sync signal, the horizontal sync signal, and the pixel clock signal may be embedded in and transmitted as the input image data PDIN. In this case, the input interface circuit 110 extracts part or all of the vertical sync signal, the horizontal sync signal, and the pixel clock signal embedded in the input image data PDIN. The input interface circuit 110 outputs the acquired input image data PDIN and timing control signal to the processing circuit 120 and outputs a pixel clock signal CKPIN to the frequency dividing circuit 140. The pixel clock signal CKPIN is also referred to as a first clock signal.

The input interface circuit 110 may be an interface circuit compliant with any of a variety of image interface standards, for example, LVDS, DVI, DisplayPort, GMSL, and GVIF. LVDS is an abbreviation for low voltage differential signaling, DVI is an abbreviation for digital visual interface, GMSL is an abbreviation for gigabit multimedia serial link, and GVIF is an abbreviation for gigabit video interface. Among a variety of LVDS standards, for example, OpenLDI, which uses four pairs of data-carrying differential signal lines and one pair of clock-carrying differential signal lines, can be employed. OpenLDI is an abbreviation for an open LVDS display interface.

The processing circuit 120 includes an image data dividing circuit 121, which divides the input image data PDIN into the three output image data PDQ1 to PDQ3. The processing circuit 120 further includes a speed difference absorbing buffer circuit 122 and an adjustment circuit 123. The speed difference absorbing buffer circuit 122 absorbs the difference in speed between the input rate of the input image data PDIN and the output rate of the output image data PDQ1 to PDQ3 by temporarily buffering the input image data PDIN. The adjustment circuit 123 synchronizes the frame rate of the input image data PDIN with the frame rate of the output image data PDQ1 to PDQ3 by adjusting at least one of the total number of horizontal pixels and the total number of vertical pixels of the output image data PDQ1 to PDQ3 including the blanking period. These processes will be described later in details.

The image data dividing circuit 121 and the adjustment circuit 123 are logic circuits. The logic circuits may be configured, for example, as separate circuits or as a circuit integrated, for example, by automatic placed wiring. Some or all of the logic circuits may be achieved by a processor, such as a DSP. DSP is an abbreviation for a digital signal processor. In this case, a program or an instruction set that describes the functions of the circuits is stored in a memory, and the processor executes the program or the instruction set to achieve the functions of the circuits. The speed difference absorbing buffer circuit 122 is a register formed, for example, of a semiconductor memory, such as a RAM, or a latch circuit.

The frequency dividing circuit 140 generates a pixel clock signal CKPQ by dividing the frequency of the pixel clock signal CKPIN by three and outputs the pixel clock signal CKPQ to the output interface circuit 130. The pixel clock signal CKPIN is a clock signal so configured that one pulse thereof corresponds to one pixel of the input image data PDIN, and the pixel clock signal CKPQ is a clock signal so configured that one pulse thereof corresponds to one pixel of each of the output image data PDQ1 to PDQ3. The pixel clock signal CKPQ is also referred to as a second clock signal.

The output interface circuit 130 includes an output circuit 131 for a first channel, which outputs the output image data PDQ1 to the display driver 210, an output circuit 132 for a second channel, which outputs the output image data PDQ2 to the display driver 220, and an output circuit 133 for a third channel, which outputs the output image data PDQ3 to the display driver 230.

Specifically, the output circuit 131 for a first channel generates an image interface signal for transmitting the output image data PDQ1 based on the output image data PDQ1 and the pixel clock signal CKPQ and transmits the image interface signal to the display driver 210. The output circuit 131 for a first channel may transmit the output image data PDQ1, the vertical sync signal, the horizontal sync signal, and the pixel clock signal via respective dedicated signal lines. Instead, the output circuit 131 for a first channel may embed part or all of the vertical sync signal, the horizontal sync signal, and the pixel clock signal in the output image data PDQ1 and transmit the resultant output image data PDQ1. The operation of the output circuit 131 for a first channel has been described above, and the same applies to the operation of the output circuit 132 for a second channel and the output circuit 133 for a third channel.

The output circuits 131 to 133 for first to third channels may each be an interface circuit compliant with any of a variety of image interface standards, for example, LVDS, DVI, DisplayPort, GMSL, and GVIF. The interface standards employed by the output circuits 131 to 133 for first through third channels may be the same as or differ from the interface standard employed by the input interface circuit 110.

2. Image Data Division

Figure 2:
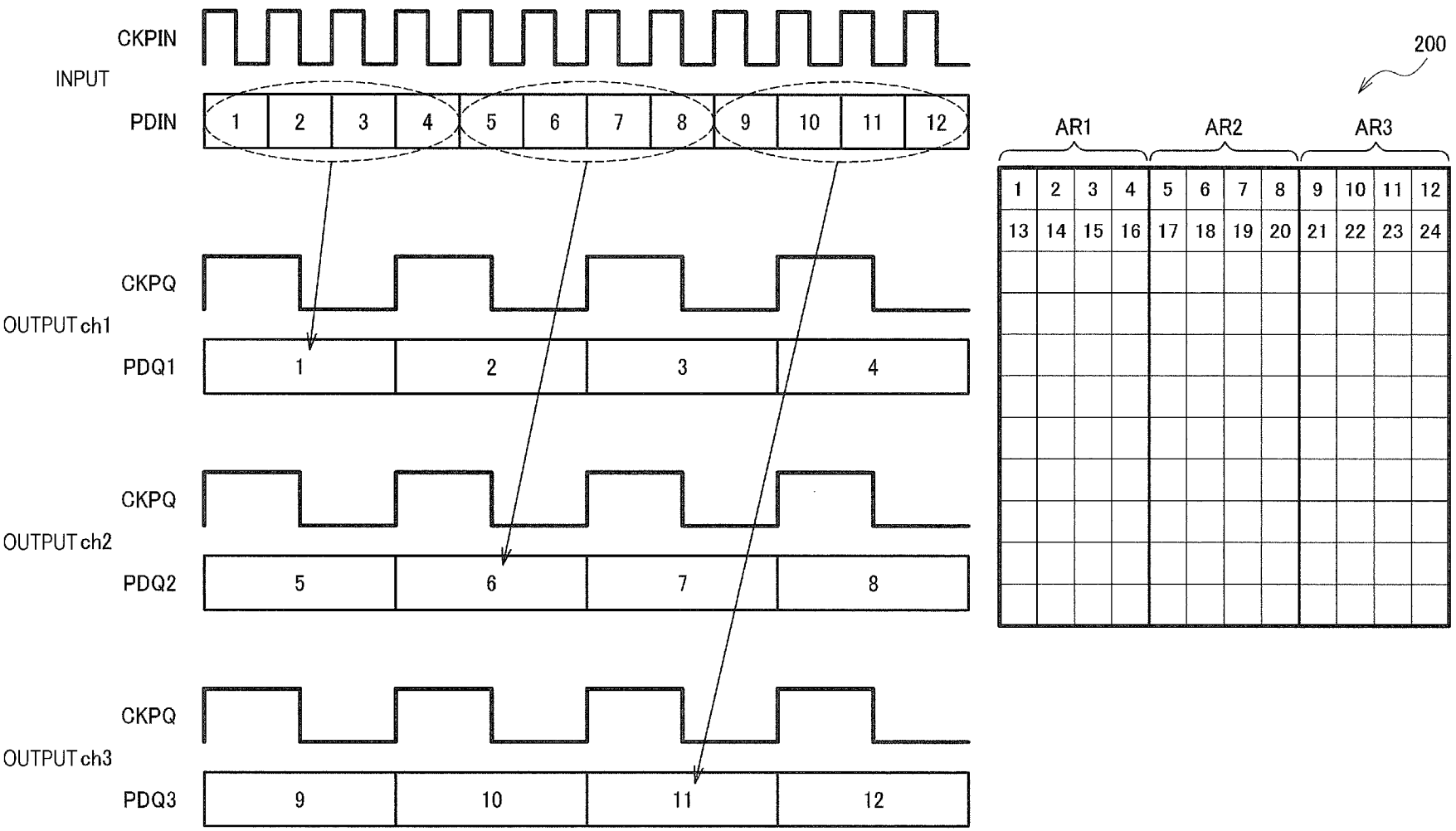
FIG. 2 describes how to divide image data.

FIG. 2 describes how to divide image data. The left portion of FIG. 2 shows a waveform diagram, and the right portion of FIG. 2 shows the pixel array of the electro-optical panel 200.

In the right portion of FIG. 2, one quadrangle represents one pixel. Pixel numbers are assigned to the quadrangles in the first and second lines. In the entire pixel array, the number of pixels in the horizontal scanning direction is set at 12, and the number of pixels in the vertical scanning direction is set at 11. The pixel array is divided into 3 areas AR1 to AR3 with the number of pixels in the horizontal scanning direction in each of the areas being 4 and the number of pixels in the vertical scanning direction in each of the areas being 11. In the configuration described above, the display driver 210 drives the pixel array area AR1, the display driver 220 drives the pixel array area AR2, and the display driver 230 drives the pixel array area AR3.

The image data dividing circuit 121 divides the input image data PDIN corresponding to the entire pixel array into the output image data PDQ1 to PDQ3 corresponding to the areas AR1 to AR3. On the input side, one pulse of the pixel clock signal CKPIN corresponds to data on one pixel, as shown in the left portion of FIG. 2. The numbers attached to the waveform of the input image data PDIN correspond to the numbers attached to the pixels in the right portion of FIG. 2. The waveform shows 1, 2, . . . , 12, which is followed by 13, 14, . . . . The image data dividing circuit 121 sets the data on the pixels 1, 2, 3, 4, 13, 14, . . . as the output image data PDQ1, the data on pixels 5, 6, 7, 8, 17, 18, . . . as the output image data PDQ2, and the data on pixels 9, 10, 11, 12, 21, 22, . . . as the output image data PDQ3. On the output side, one pulse of the pixel clock signal CKPQ corresponds to data on one pixel. Since the frequency of the pixel clock signal CKPQ is one-third of the frequency of the pixel clock signal CKPIN, one pixel in the output image data PDQ1 corresponds to three pixels in the input image data PDIN in terms of pixel display period. The same holds true for the output image data PDQ2 and PDQ3.

In FIG. 2, the number of pixels in one line of the input image data PDIN is 12, which is divisible by 3. That is, the number of pixels in one line of the output image data PDQ1 can be set at 12/3=4. In this case, since the length of the horizontal scanning period is the same on the input and output sides, the frame rate is also the same on the two sides, and the frame rates on the input and output sides synchronize with each other. However, When the number of pixels in one line of the input image data PDIN is not divisible by 3, the frame rates on the input and output sides do not synchronize with each other, resulting in a display error. Description will be made of the point described with reference to FIGS. 3 and 4.

Figure 3:
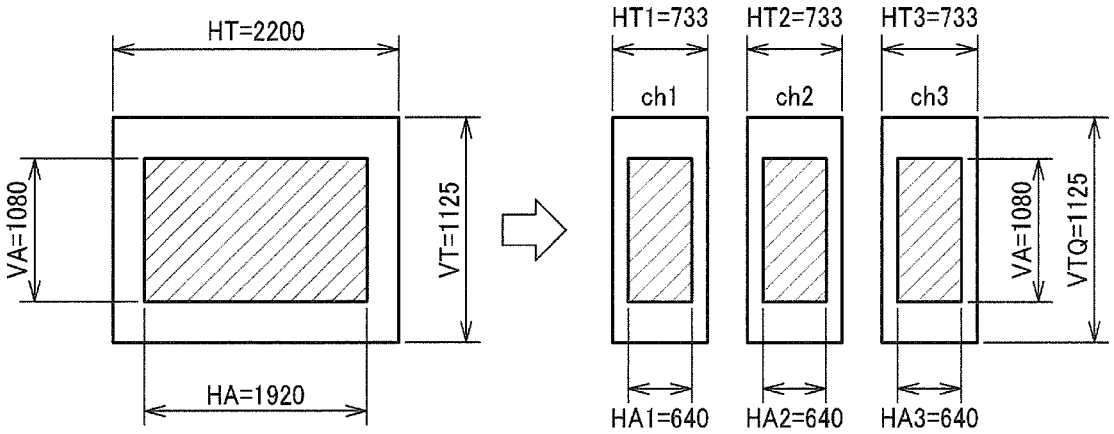
FIG. 3 shows an example of how to divide image data without using a method according to the present embodiment.
Figure 4:
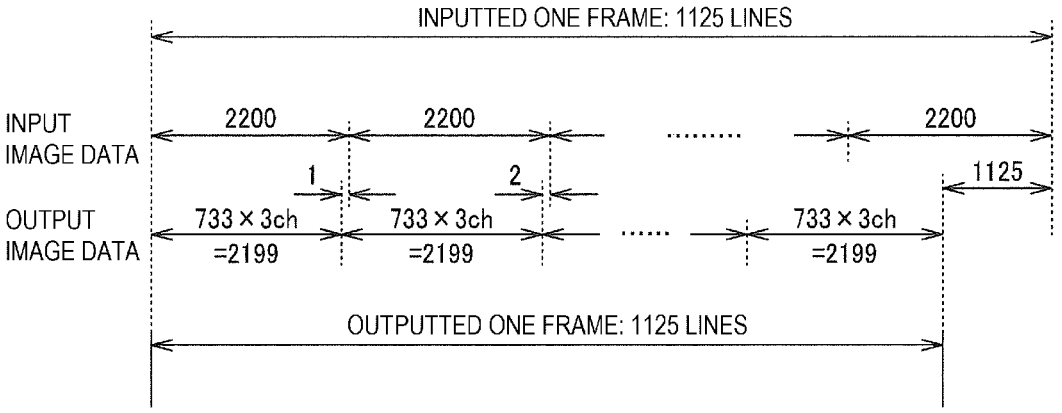
FIG. 4 shows an example of how to divide image data without using the method according to the present embodiment.

FIGS. 3 and 4 show an example of how to divide image data without using a method according to the present embodiment. The following description primarily uses the number of pixels and the number of lines, and the number of pixels and the number of lines can each be replaced by a period. That is, since one pixel corresponds to one pulse of the pixel clock, as described in FIG. 2, the number of pixels is synonymous with the length of the period determined by the number of pulses of the pixel clock. Similarly, one line is synonymous with the length of the horizontal scanning period because a fixed number of pixels are contained in one line.

In FIG. 2, only the pixels in an active period, that is, active pixels having image data, are considered. In reality, however, a frame contains the blanking period and the active period. Let HT×VT be the total number of pixels in one frame of the input image data PDIN, and HA×VA be the number of active pixels, as shown in the left portion of FIG. 3. In FIG. 3, the active pixels are hatched. The area that is not hatched corresponds to the blanking period. The blanking period has no effective pixels but can be considered in terms of the number of pixels as described above.

HT represents the total number of horizontal pixels and means the total number of pixels in the horizontal scanning direction including the blanking period. The total number of horizontal pixels is also called a horizontal total. HA represents the number of horizontal active pixels, and HT-HA is the number of pixels in the horizontal blanking period. For example, the total number of horizontal pixels HT, the number of pixels in a horizontal front porch period, and the number of horizontal active pixels HA are set as timing control information. The horizontal front porch period means the blanking period before the active period in one line.

VT represents the total number of vertical lines and means the total number of lines in one frame including the blanking period. The total number of vertical lines is also called a vertical total. VA represents the number of vertical active lines, and VT-VA is the number of lines in the vertical blanking period. For example, the total number of vertical lines VT, the number of lines in a vertical front porch period, and the number of vertical active lines VA are set as the timing control information. The vertical front porch period means the blanking period before the active lines in one vertical scanning period.

FIG. 3 shows the number of pixels in full-HD image data as an example. In full-HD image data, HA=1920 and VA=1080. It is typical to set HT=2200 and VT=1125.

The right portion of FIG. 3 shows output image data after the image division. Channels Ch1 to Ch3 correspond to the output image data PDQ1 to PDQ3, respectively. A total number of vertical lines VTQ=1125 and the number of vertical active lines VA=1080 are the same as those in the input image data. The numbers of horizontal active pixels in the channels Ch1 to Ch3 are set at HA1 to HA3, respectively. FIG. 3 shows an example in which the number of horizontal active pixels on the input side, HA=1920, is divided into three equal portions, HA1=HA2=HA3=640. It is, however, noted that HA1, HA2, and HA3 may differ from one another as long as HA1+HA2+HA3=HA is satisfied.

The total numbers of horizontal pixels in the channels Ch1 to Ch3 are set at HT1 to HT3, respectively. When the total number of horizontal pixels on the input side, HT=2200, is divided into three equal portions, HT1=HT2=HT3=2200/3=733.33 is derived. However, since the total numbers of horizontal pixels are each an integer, HT1, HT2, and HT3 can only be 733 or 734. In this case, 733×3≠2200 and 734×3≠2200, which both cause the length of the horizontal scanning period to differ between the input and output sides, so that the frame rates on the input and output sides do not synchronize with each other. FIG. 3 shows an example in which HT1=HT2=HT3=733 is satisfied.

FIG. 4 describes that the frame rates on the two sides do not synchronize with each other. The output image data in FIG. 4 corresponds to one channel that may be any of the channels Ch1 to Ch3. With respect to the number of pixels in the input image data, the horizontal scanning period on the output side is shorter by 2200−733×3=1 pixel per line than the horizontal scanning period on the input side. Since one frame contains 1125 lines, the frame on the output side decreases by 1125 pixels per frame, which means that the vertical synchronization between the input and the output shifts by 1125 pixels per frame.

As described above, when the total number of horizontal pixels HT is not divisible by the number of channels n on the output side, the frame rate is undesirably not the same on the input and output sides. When the frame rate is not the same on the two sides, that is, when vertical synchronization is not achieved, data transfer or image display is not normally performed, resulting in display errors.

3. Method According to Present Embodiment

Figure 5:
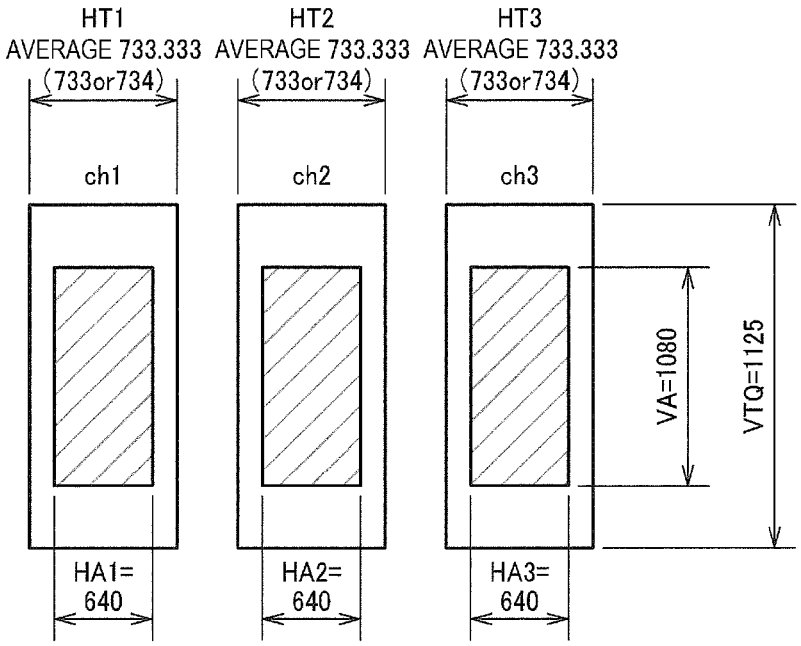
FIG. 5 describes a first method.
Figure 6:
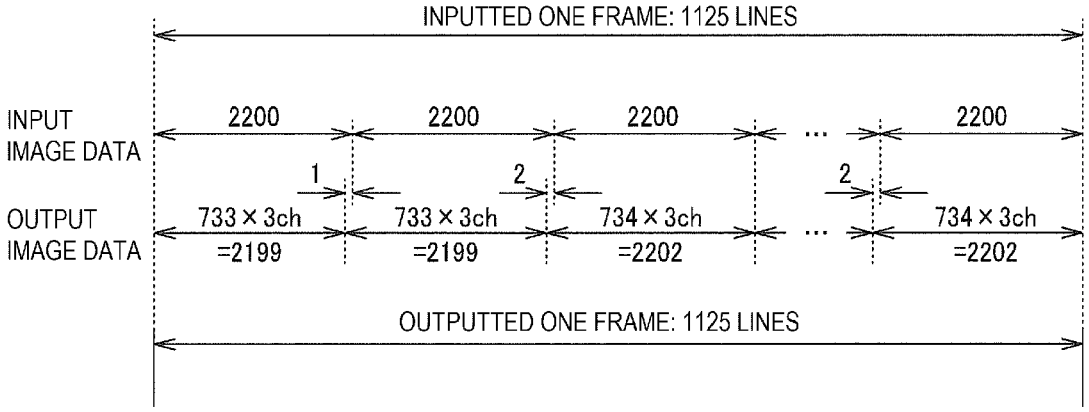
FIG. 6 describes the first method.

FIGS. 5 and 6 describe a first method according to the present embodiment. FIG. 5 shows output image data after the image division. The input image data is the same as that in FIG. 3.

The image data dividing circuit 121 divides the image data formed of the 1920×1080 active pixels in the input image data into image data formed of 640×1080 active pixels per channel in the output image data. The numbers of horizontal active pixels HA1 to HA3 in the channels Ch1 to Ch3 may differ from one another, as described above.

The adjustment circuit 123 sets the total numbers of horizontal pixels HT1 to HT3 in the channels Ch1 to Ch3 to be variable in each line. In the case of the channel Ch1 by way of example, the adjustment circuit 123 provides lines each configured by HT1=733 and lines each configured by HT1=734 at the ratio between the former and latter being 2:1, so that HT1=(733×2+734)/3=733.33 is achieved in the time average. For example, a 3-line cycle of HT1=733, 733, 734 is repeated. It is, however, noted that the 3-line cycle is not necessarily employed. For example, a 6-line cycle of HT1=733, 733, 733, 733, 734, 734 may be employed. It is not necessary that HT1=HT2=HT3 is satisfied in the same line in the channels Ch1 to Ch3. It is not necessary that HT1=HT2=HT3 is satisfied in the same line in the channels Ch1 to Ch3. For example, (HT1, HT2, HT3)=(733, 733, 734), (733, 734, 733), (734, 733, 733) may be satisfied in the first, second, and third lines, respectively.

The adjustment circuit 123 may control the total numbers of horizontal pixels HT1 to HT3 themselves or may control the horizontal blanking period in each of the channels. For example, considering that HT1−HA1 is the number of pixels in the horizontal blanking period in the channel Ch1, it can be said that controlling the total number of horizontal pixels HT1 is equivalent to controlling the horizontal blanking period. The same holds true for the channels Ch2 and Ch3.

As shown in FIG. 6, consider the horizontal scanning period corresponding to 3 lines, and 2200×3=(733+733+734)×3 is achieved, so that the horizontal scanning period corresponding to 3 lines is the same on the input and output sides. When the total number of vertical lines VT=1125 is satisfied, VT is divisible by 3, so that the frame length is the same on the input and output sides, and the vertical synchronization is achieved on a frame basis. Even when VT is not divisible by 3, the vertical synchronization is achieved whenever frames the number of which is a multiple of 3 are displayed, so that the frame rate is the same in the time average on the input and output sides.

In the present embodiment described above, the image dividing circuit 100 includes the input interface circuit 110, the image data dividing circuit 121, and the output interface circuit 130. The input interface circuit 110 receives the input image data PDIN configured by the total number of horizontal pixels HT and the total number of vertical lines VT. The image data dividing circuit 121 divides the input image data PDIN into first to n-th output image data for first to n-th channels. The output interface circuit 130 includes output circuits for first to n-th channels that output the first to n-th output image data. The parameter n is an integer greater than or equal to 3, and HT is not an integer multiple of n. The output circuit for an i-th channel outputs i-th output image data in which at least one of a total number of horizontal pixels HTi and the total number of vertical lines VTQ in the i-th channel has been variably adjusted. The parameter i is an integer greater than or equal to 1 but smaller than or equal to n.

In FIGS. 1 to 6, the case where n=3 has been described. The output image data PDQ1 to PDQ3 correspond to the first to n-th output image data, and the output circuits 131 to 133 for first to third channels correspond to the output circuits for first to n-th channels. The first method has been described with reference to the case where the total number of horizontal pixels HTi is adjusted, and the total number of vertical lines VTQ may instead be adjusted, as will be described later in the description of a third method.

According to the present embodiment, even when the total number of horizontal pixels HT on the input side is not an integer multiple of n, the frame rate can be the same in the time average on the input and output sides by variably adjusting at least one of the total number of horizontal pixels HTi and the total number of vertical lines VTQ in the i-th channel. The data input rate at which data is inputted to the input interface circuit 110 thus coincides in the time average with the data output rate at which data is outputted from the output interface circuit 130, whereby display errors can be avoided.

In the present embodiment, the input interface circuit 110 outputs the first clock signal, which is the pixel clock signal CKPIN for the input image data PDIN, and the received input image data PDIN. The output circuits for first to n-th channels output the first to n-th output image data by using the pixel clock signal CKPQ, which is the second clock signal having a frequency that is 1/n of the frequency of the first clock signal.

The data output rate per output channel needs to be 1/n of the data input rate. However, when the total number of horizontal pixels HT on the input side is not an integer multiple of n, the total number of horizontal pixels per channel on the output side cannot be HT/n, as described in FIGS. 3 and 4, the data output rate per output channel is not 1/n of the data input rate. According to the present embodiment, at least one of the total number of horizontal pixels HTi and the total number of vertical lines VTQ in the i-th channel is variably adjusted, whereby the data output rate per output channel can be 1/n of the data input rate in the time average. The data output rate thus coincides with the data input rate in the n channels as a whole, whereby the frame rate can be the same on the input and output sides.

In the present embodiment, the image dividing circuit 100 includes the frequency dividing circuit 140. The frequency dividing circuit 140 divides the frequency of the first clock signal by n and outputs the resultant second clock signal.

According to the present embodiment, the second clock signal having a frequency that is 1/n of the frequency of the pixel clock signal CKPIN, which is the first clock signal, is inputted as the pixel clock signal CKPQ to the output circuits for first to n-th channels. In the present embodiment, the data output rate per output channel can be set at 1/n of the data input rate in the time average, whereby the frame rate can be the same on the input and output sides in the data input/output operation using the first and second clock signals described above.

In the present embodiment, let TN be the total number of pixels in the input image data PDIN including the blanking period. The output circuit for an i-th channel outputs i-th output image data PDQi, in which at least one of the total number of horizontal pixels HTi and the total number of vertical lines VTQ in the i-th channel has been so variably adjusted that the time average of the total number of pixels including the blanking period in the i-th channel is TN/n.

The total number of pixels on the input side is HT×VT, and the total number of pixels on the output side is HTi×VTQ. According to the present embodiment, at least one of the total number of horizontal pixels HTi and the total number of vertical lines VTQ is variably adjusted, so that the time average of the total number of pixels per channel is HTi×VTQ=(HT×VT)/n. The total number of pixels corresponds to the frame length, and when HTi×VTQ=(HT×VT)/n is satisfied in the time average, the frame rate is the same on the input and output sides.

In the present embodiment, the image dividing circuit 100 includes the adjustment circuit 123. The adjustment circuit 123 variably adjusts at least one of the total number of horizontal pixels HTi and the total number of vertical lines VTQ in the i-th channel.

As described above, controlling the total number of horizontal pixels HTi is equivalent to controlling the horizontal blanking period. Similarly, controlling the total number of vertical lines VTQ is equivalent to controlling the vertical blanking period. It can therefore also be said that the adjustment circuit 123 variably adjusts at least one of the horizontal blanking period and the vertical blanking period in the i-th channel.

According to the present embodiment, the adjustment circuit 123 variably adjusts at least one of the total number of horizontal pixels HTi and the total number of vertical lines VTQ in the i-th channel, whereby the output circuit for an i-th channel can output the i-th output image data in which at least one of the total number of horizontal pixels HTi and the total number of vertical lines VTQ in the i-th channel has been variably adjusted.

In the present embodiment, the image dividing circuit 100 includes the speed difference absorbing buffer circuit 122. The speed difference absorbing buffer circuit 122 absorbs the difference between the data input rate at which data is inputted to the input interface circuit 110 and the data output rate at which data is outputted from the output interface circuit 130. The data output rate at which data is outputted from the output interface circuit 130 is the output rate at which the sum of the first to n-th output image data is outputted.

In the present embodiment, the frame rate can be the same in the time average on the input and output sides, but there is a temporary difference between the data input rate and the data output rate. For example, in FIG. 6, there is a temporary difference corresponding to one or two pixels between the input and output. According to the present embodiment, the temporary difference between the data input rate and the data output rate is absorbed by the provided speed difference absorbing buffer circuit 122.

In the present embodiment, the adjustment circuit 123 adjusts the total number of horizontal pixels HTi in the i-th channel in such a way that the total number of horizontal pixels HTi in the first line and the total number of horizontal pixels HTi in the second line of one frame differ from each other.

The first line may be an arbitrary line among the lines in one frame, and the second line is the line that follows the first line. For example, assuming that the line that comes second is the first line and the line that comes third is the second line in FIG. 6, the total number of horizontal pixels in the first line is HTi=733, and the total number of horizontal pixels in the second line is HTi=734.

According to the present embodiment, the total number of horizontal pixels HTi is so adjusted that lines configured by different total numbers of horizontal pixels HTi are mixed with one another in one frame. The frame rate can thus be the same in the time average on the input and output sides.

In the present embodiment, the adjustment circuit 123 adjusts the total number of horizontal pixels HTi in such a way that the average of the total number of horizontal pixels HTi in n×k lines (k is an integer greater than or equal to 1) in the i-th channel is HT/n.

For example, in FIG. 6, in which n=3, k=1, and HT=2200, the average of the total number of horizontal pixels HTi in n×k=3 lines is (733+733+734)/3=2200/3.

According to the present embodiment, the total numbers of horizontal pixels on the output side that are averaged over n×k lines is HTi=HT/n. The frame rate is thus the same in the time average on the input and output sides.

Figure 7:
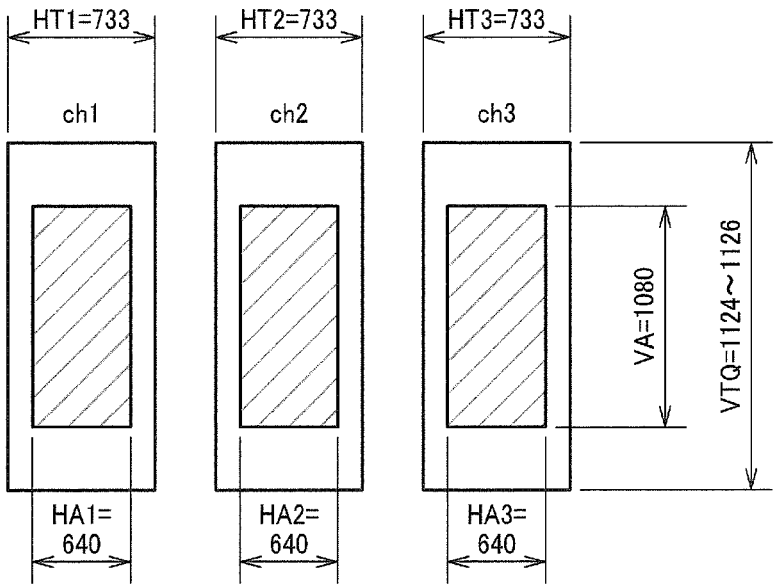
FIG. 7 describes a second method.
Figure 8:
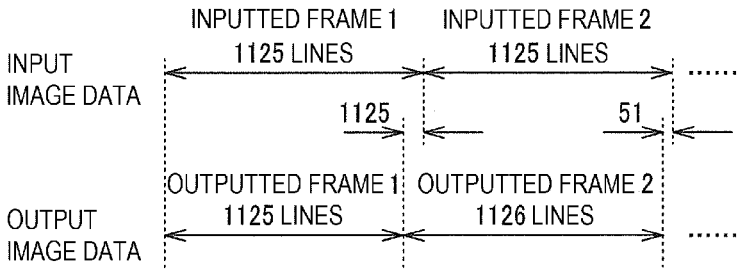
FIG. 8 describes the second method.

FIGS. 7 and 8 describe a second method according to the present embodiment. FIG. 7 shows output image data after the image division. The input image data is the same as that in FIG. 3.

In the second method, the total numbers of horizontal pixels in the channels Ch1 to Ch3 are fixed at HT1=HT2=HT3=733 or HT1=HT2=HT3=734. FIG. 7 shows an example in which HT1=HT2=HT3=733 is satisfied. The adjustment circuit 123 sets the total numbers of vertical lines VTQ in the channels Ch1 to Ch3 to be variable in each frame. In the case where HT1=733 is satisfied in the channel Ch1 by way of example, 733×3×1125−2200×1125=−1125 is derived when VTQ=1125 is satisfied, so that the frame on the output side is shorter by 1125 pixels in terms of the number of pixels on the input side, whereas 733×3×1126−2200×1125=1074 is derived when VTQ=1126 is satisfied, so that the frame on the output side is longer by 1074 pixels in terms of the number of pixels on the input side. The adjustment circuit 123 combines the cases described above with each other to achieve the same frame rate in the time average.

When the total numbers of vertical lines in the first and second frames are 1125 and 1126, respectively, in the output image data, −1125+1074=−51 is derived, so the length of the two frames on the output side is shorter by 51 pixels in terms of the number of pixels on the input side, as shown in FIG. 8. Appropriately setting the total number of vertical lines in a large number of frames, however, achieves the same frame rate in the time average. Specifically, frames each configured by the total number of vertical lines of 1125 and frames each configured by the total number of vertical lines of 1126 may be provided at the ratio between the former and the latter being 1074:1125.

The adjustment circuit 123 may control the total number of vertical lines VTQ itself or may control the vertical blanking period in each of the channels. For example, considering that VTQ−VA is the number of lines in the vertical blanking period in the channel Ch1, it can be said that controlling the total number of vertical lines VTQ is equivalent to controlling the vertical blanking period. The same holds true for the channels Ch2 and Ch3.

In the present embodiment described above, the adjustment circuit 123 adjusts the total number of vertical lines VTQ in the i-th channel in such a way that the total number of vertical lines VTQ in the first frame differs from the total number of vertical lines VTQ in the second frame.

The first frame may be an arbitrary frame, and the second frame is the frame that follows the first frame. For example, when the frame that comes first is the first frame and the frame that comes second is the second frame in FIG. 8, the total number of vertical lines in the first frame is VTQ=1125, and the total number of vertical lines in the second frame is VTQ=1126.

Since the total number of horizontal pixels HT on the input side is not divisible by n, HT/n is not an integer. Since the total numbers of horizontal pixels HTi on the output side are each an integer, there is a difference between HTi and HT/n. If it is assumed that the total number of vertical lines on the output side is VTQ=VT, the difference described above is accumulated for the VT lines. According to the present embodiment, the accumulated difference described above is canceled by adjusting the total number of vertical lines VTQ in such a way that a plurality of frames configured by different total numbers of vertical lines VTQ are mixed with one another. The frame rate can thus be the same in the time average on the input and output sides.

Figure 9:
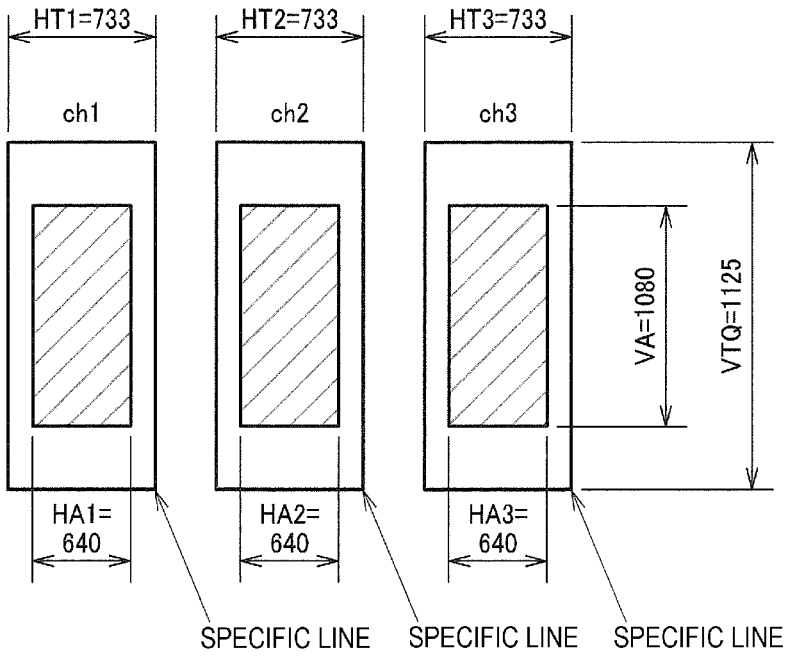
FIG. 9 describes a third method.
Figure 10:
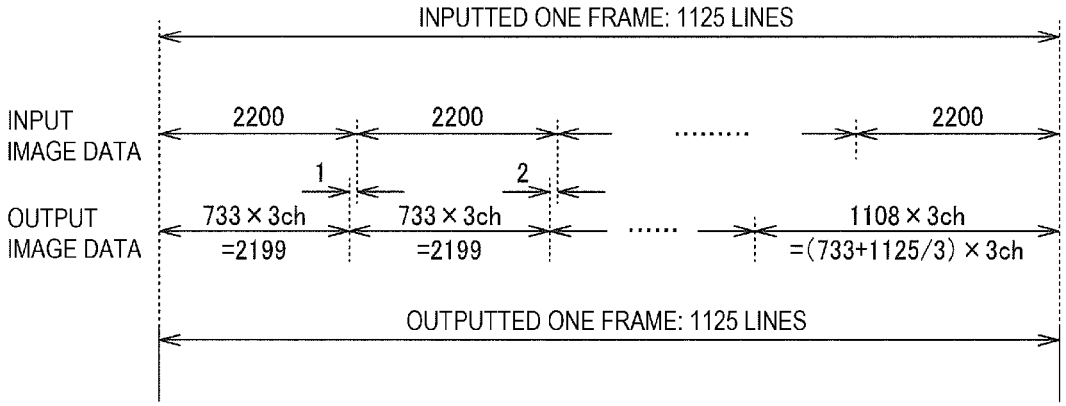
FIG. 10 describes the third method.

FIGS. 9 and 10 describe a third method according to the present embodiment. FIG. 9 shows output image data after the image division. The input image data is the same as that in FIG. 3.

In the third method, the total number of vertical lines is fixed at VTQ=1125. The adjustment circuit 123 sets HT1=HT2=HT3=733 in the 1125 lines excluding a specific line and sets HT1=HT2=HT3≠733 in the specific line. Alternatively, the adjustment circuit 123 sets HT1=HT2=HT3=734 in the 1125 lines excluding the specific line and sets HT1=HT2=HT3≠734 in the specific line. The adjustment circuit 123 determines the total numbers of horizontal pixels HT1 to HT3 in the specific line in such a way that the frame length is the same on the input and output sides. FIG. 9 shows a case where HT1=HT2=HT3=733 is set in the lines excluding the specific line. The specific line is, for example, but not limited to, the last line of a frame. The specific line may be formed of a plurality of lines.

FIG. 10 shows a case where the specific line is the last line and the total number of horizontal pixels is set at 733 in the other lines. In this case, the total number of horizontal pixels in the last line is set at 1108 pixels in the output image data. Since 2200×1125=733×3×1124+1108×3 is derived, the frame length is the same on the input and output sides, and the frame rate is the same on the two sides.

In the present embodiment described above, the adjustment circuit 123 sets the total numbers of horizontal pixels HTi in VT-s lines in one frame at a common setting value and sets the total number of horizontal pixels HTi in a specific s line at a value different from the setting value described above in the i-th channel. The parameter s is an integer greater than or equal to 1.

For example, the total number of horizontal pixels HTi is adjusted only in the last line, in FIGS. 9 and 10. That is, s=1. However, when the total number of horizontal pixels HTi decreases in the vicinity of the last line, the total numbers of horizontal pixels HTi in two or more lines may be adjusted, as will be described with reference to FIG. 19. Note that when a line is so adjusted that HTi=0 is satisfied, the line is deleted.

Since the total number of horizontal pixels HT on the input side is not divisible by n, HT/n is not an integer. The total numbers of horizontal pixels HTi in the VT−s lines are set at a common setting value, but the common setting value is an integer, so that HTi differs from HT/n. The difference is accumulated for the VT−s lines. According to the present embodiment, the accumulated difference described above is canceled by setting the total number of horizontal pixels HTi in the specific s line at a value different from the setting value on the output side. The frame rate can thus be the same in the time average on the input and output sides.

Figure 11:
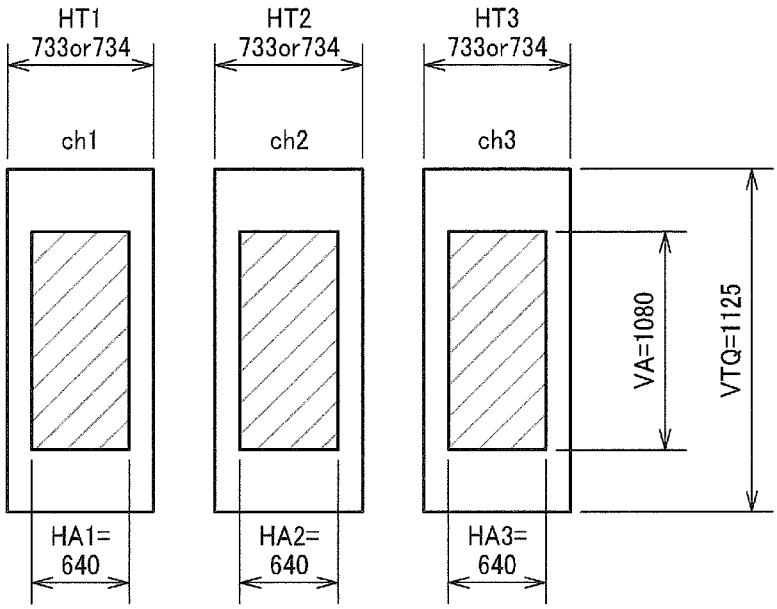
FIG. 11 describes a fourth method.
Figure 12:
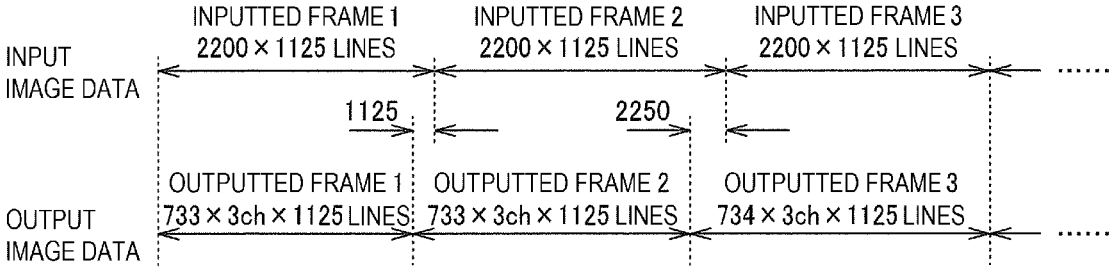
FIG. 12 describes the fourth method.

FIGS. 11 and 12 describe a fourth method according to the present embodiment. FIG. 11 shows output image data after the image division. The input image data is the same as that in FIG. 3.

In the fourth method, the total number of vertical lines is fixed at VTQ=1125. The adjustment circuit 123 fixes the total numbers of horizontal pixels HT1 to HT3 at 733 or 734 in one frame and sets the total numbers of horizontal pixels HT1 to HT3 to be variable on a frame basis. In the case of the channel Ch1 by way of example, the adjustment circuit 123 provides frames each configured by HT1=733 and frames each configured by HT1=734 at the ratio between the former and latter being 2:1, so that HT1=(733×2+734)/3=733.33 is achieved in the time average. For example, a 3-frame cycle of HT1=733, 733, 734 is repeated. However, the 3-frame cycle does not need to be employed, and, for example, a 6-frame cycle of HT1=733, 733, 733, 733, 734, 734 may be employed. It is not necessary that HT1=HT2=HT3 is satisfied in the same frame in the channels Ch1 to Ch3. For example, (HT1, HT2, HT3)=(733, 733, 734), (733, 734, 733), (734, 733, 733) may be satisfied in the first, second, and third lines, respectively.

Consider the length of three frames, and 2200×1125×3=(733+733+734)×1125×3 is satisfied, whereby the length of three frames is the same on input and output sides, as shown in FIG. 12. That is, the vertical synchronization is achieved every 3 frames, so that the frame rate is the same in the time average on the input and output sides.

In the present embodiment described above, the adjustment circuit 123 sets the total number of horizontal pixels HTi in a first frame at a first setting value and sets the total number of horizontal pixels HTi in a second frame at a second setting value different from the first setting value in the i-th channel.

The first frame may be an arbitrary frame, and the second frame is the frame that follows the first frame. For example, when the frame that comes second is the first frame and the frame that comes third is the second frame in FIG. 12, the total number of horizontal pixels in the first frame is HTi=733, and the total number of horizontal pixels in the second frame is HTi=734.

According to the present embodiment, the total numbers of horizontal pixels HTi are so adjusted that a plurality of frames configured by different total numbers of horizontal pixels HTi are mixed with one another. The frame rate can thus be the same in the time average on the input and output sides.

Furthermore, in the present embodiment, the adjustment circuit 123 adjusts the total numbers of horizontal pixels HTi in such a way that the average of the total numbers of horizontal pixels HTi in the n×k frames in the i-th channel is HT/n. The parameter k is an integer greater than or equal to 1.

For example, in FIG. 12, in which n=3, k=1, and HT=2200, the average of the total numbers of horizontal pixels HTi in the n×k=3 frames is (733+733+734)/3=2200/3.

According to the present embodiment, the total numbers of horizontal pixels HTi on the output side that are averaged over the n×k frames is HT/n. The frame rate is thus the same in the time average on the input and output sides.

Figure 13:
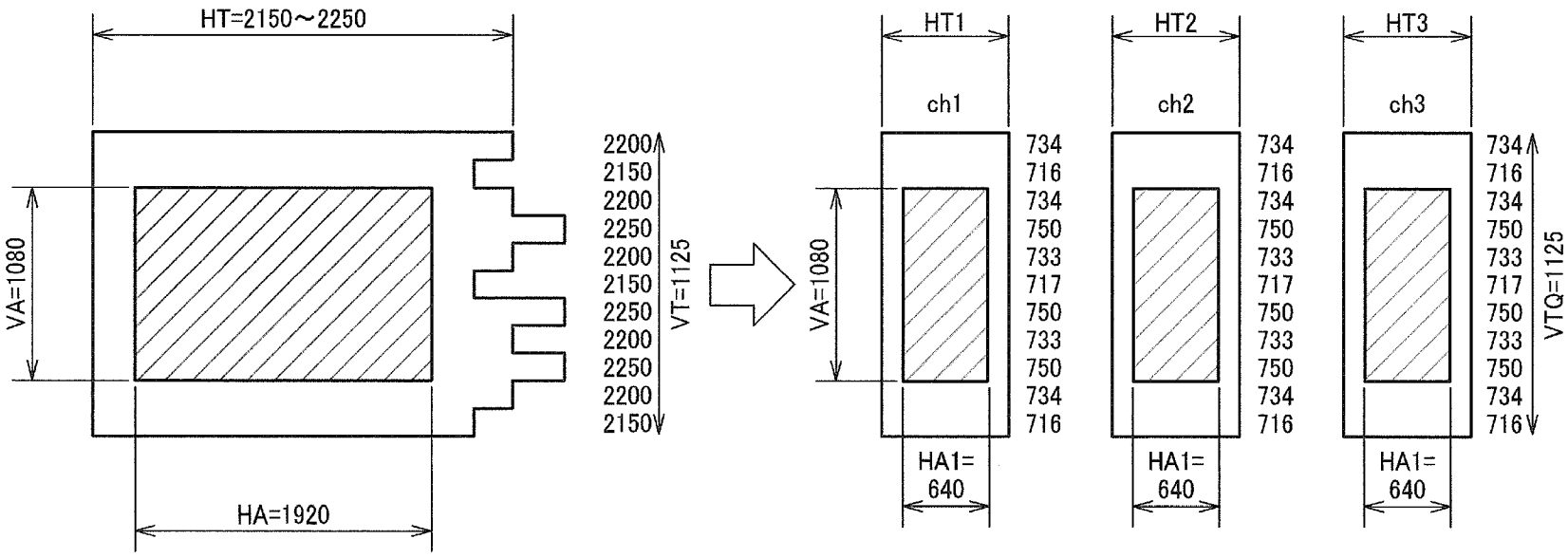
FIG. 13 describes a fifth method.

FIG. 13 describes a fifth method according to the present embodiment. In the fifth method, the total number of horizontal pixels HT in the input image data varies on a line basis. However, HT=2200 is satisfied in the time average.

The adjustment circuit 123 sets the total number of horizontal pixels in each line at about HT/3 in the output image data in the channels Ch1 to Ch3. In FIG. 13, the total number of horizontal pixels in the first line of the input image data is HT=2200. The adjustment circuit 123 sets the total number of horizontal pixels in the first line of the output image data at HT1=HT2=HT3=733 or 734. FIG. 13 shows a case where the total number of horizontal pixels is set at 734. The total number of horizontal pixels in the second line of the input image data is HT=2150. The adjustment circuit 123 sets the total number of horizontal pixels in the second line of the output image data at HT1=HT2=HT3=716 or 717. FIG. 13 shows a case where the total number of horizontal pixels is set at 716.

When the total number of horizontal pixels HT in the input image data is not divisible by 3, an excess or a deficiency occurs between the total number of horizontal pixels HT in the input image data and the sum of the total numbers of horizontal pixels HT1+HT2+HT3 in the output image data. For example, 734×3−2200=2 is satisfied in the first line, which means that the total number of horizontal pixels on the output side is greater by two pixels than that on the input side. In the second line, 716×3−2200=−2 is satisfied, which means that the total number of horizontal pixels on the output side is smaller by two pixels than that on the input side. In the example, the excess and the deficiency cancel each other out in the first and second lines, resulting in 0. The total numbers of horizontal pixels HT1 to HT3 in the output image data are thus so set that zero excess or deficiency is achieved when averaged over a plurality of lines. The frame rate is thus the same in the time average on the input and output sides.

4. Examples of Detailed Configuration

Figure 14:
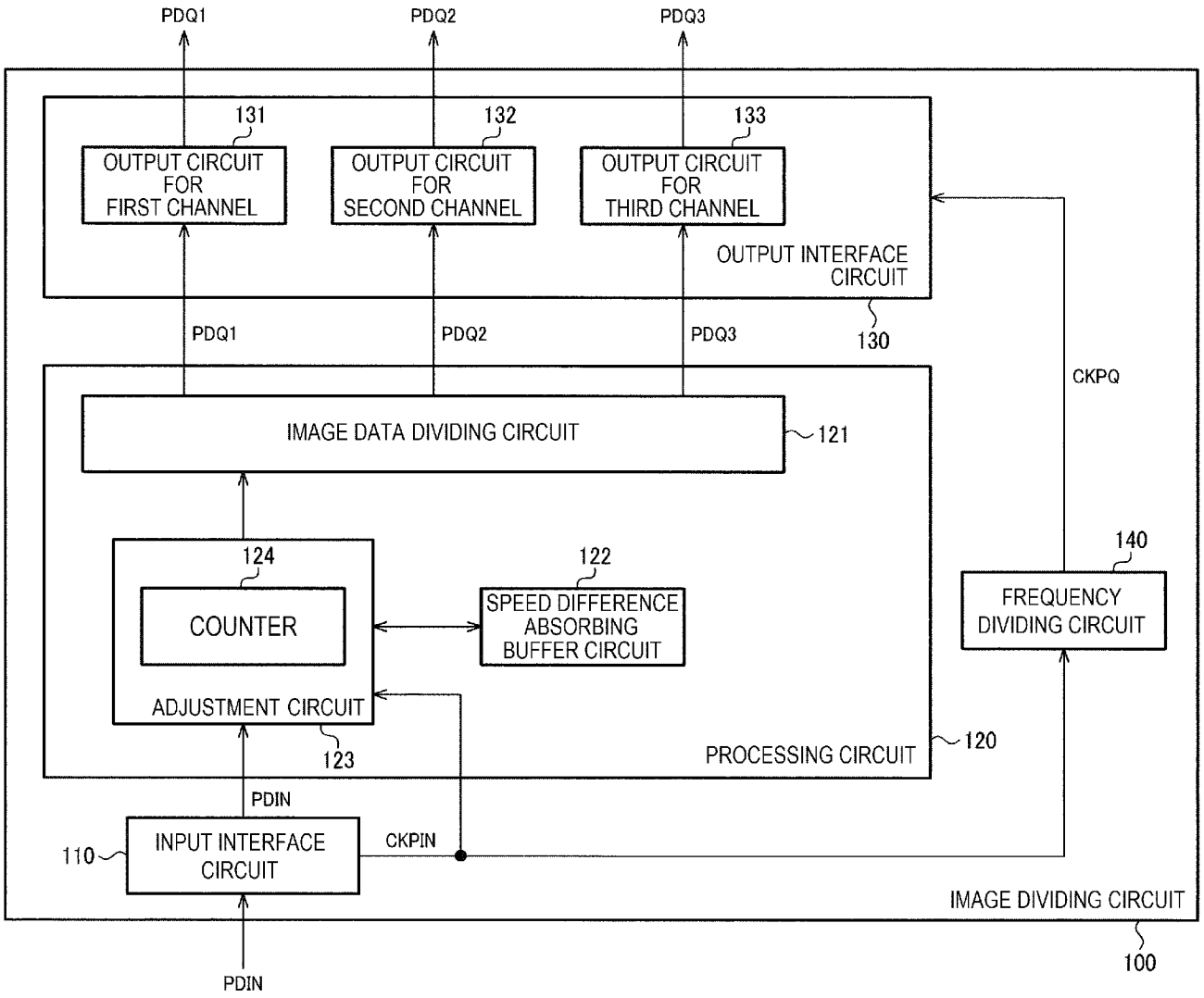
FIG. 14 shows an example of a first detailed configuration of the image dividing circuit.

FIG. 14 shows an example of a first detailed configuration of the image dividing circuit 100. In the example of the first detailed configuration, the image data dividing circuit 121 is provided on the downstream of the adjustment circuit 123. The same components as those in FIG. 1 will not be described as appropriate.

The adjustment circuit 123 includes a counter 124, which counts the pixel clock signal CKPIN. The adjustment circuit 123 measures the total number of horizontal pixels HT in the input image data PDIN, controls the buffering performed by the speed difference absorbing buffer circuit 122, and outputs the timing control information on the output timing of the output image data PDQ1 to PDQ3 based on the count measured by the counter 124.

Specifically, the adjustment circuit 123 outputs the input image data PDIN from the input interface circuit 110 or the input image data PDIN buffered by the speed difference absorbing buffer circuit 122 to the image data dividing circuit 121. The image data dividing circuit 121 holds the input image data PDIN corresponding to one line, divides the held input image data PDIN into images by using the method described with reference to FIG. 2, and outputs the output image data PDQ1 to PDQ3 to the output interface circuit 130.

In this process, the adjustment circuit 123 determines the total numbers of horizontal pixels HT1 to HT3 in the output image data PDQ1 to PDQ3 based on the total number of horizontal pixels HT contained in the input image data PDIN and measured by using the counter 124 and outputs the determined total numbers of horizontal pixels HT1 to HT3 as the timing control information to the image data dividing circuit 121. The image data dividing circuit 121 controls the output timing of the output image data PDQ1 to PDQ3 based on the total numbers of horizontal pixels HT1 to HT3 determined by the adjustment circuit 123, the numbers of horizontal active pixels HA1 to HA3, and the horizontal front porch period. The numbers of horizontal active pixels HA1 to HA3 and the horizontal front porch period may be set, for example, by register settings.

As described in the description of the first to fifth methods, the frame rate is the same in the time average on the input and output sides, but the horizontal scanning period or the frame length may not be temporarily the same on the input and output sides. The speed difference absorbing buffer circuit 122 temporarily buffers image data corresponding to the difference. In the first to fifth methods described above, a difference ranging approximately from a few pixels to one line occurs between the input and the output, and the speed difference absorbing buffer circuit 122 buffers image data formed approximately of a few pixels to one line.

Figure 15:
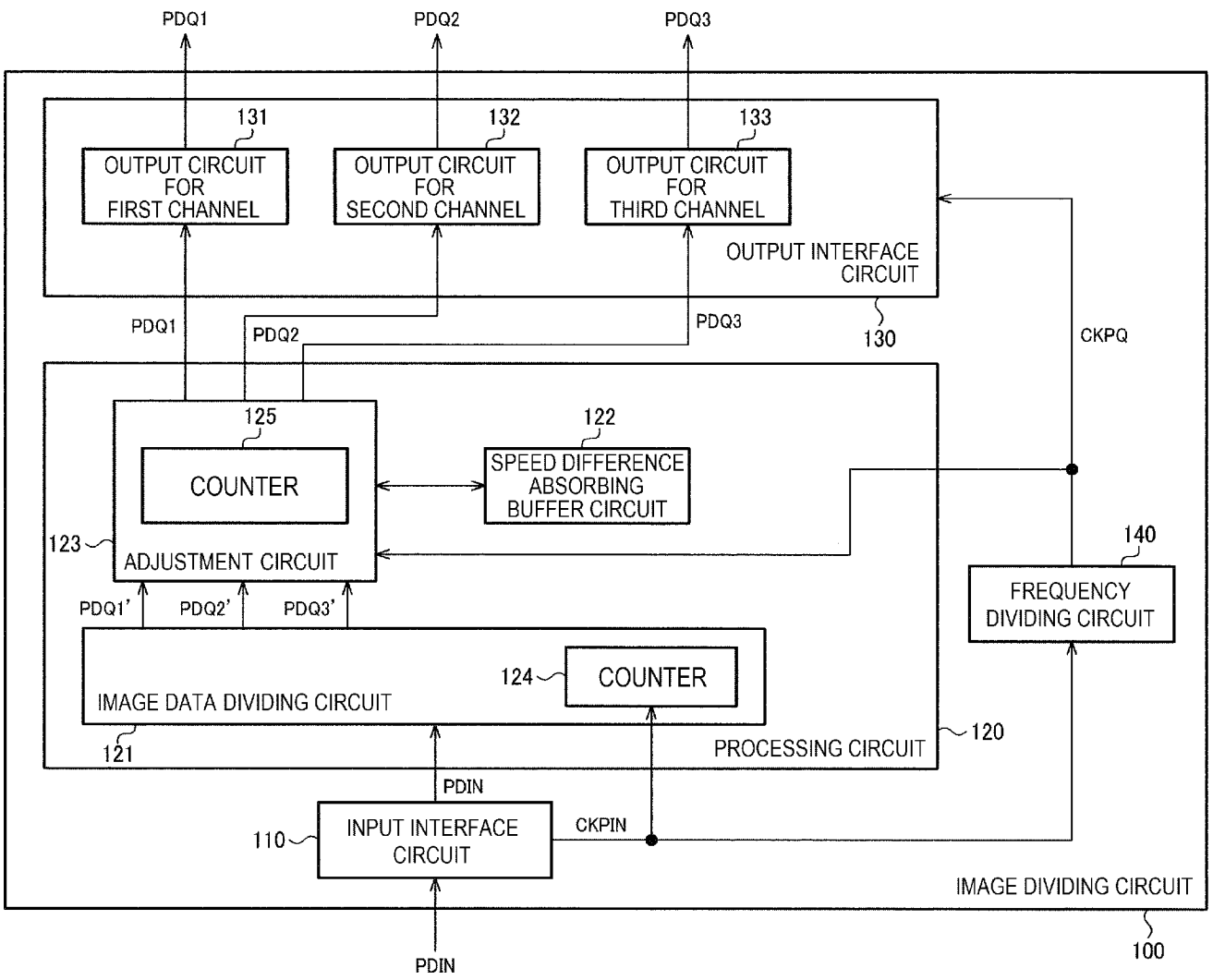
FIG. 15 shows an example of a second detailed configuration of the image dividing circuit.

FIG. 15 shows an example of a second detailed configuration of the image dividing circuit 100. In the example of the second detailed configuration, the image data dividing circuit 121 is provided on the upstream of the adjustment circuit 123. The same components as those in FIG. 1 or 14 will not be described as appropriate.

The image data dividing circuit 121 holds the input image data PDIN corresponding to one line, divides the held input image data PDIN into image data PDQ1' to PDQ3' by using the method described with reference to FIG. 2, and outputs the image data PDQ1' to PDQ3' to the adjustment circuit 123. The image data dividing circuit 121 includes the counter 124, which counts the pixel clock signal CKPIN, measures the total number of horizontal pixels HT in the input image data PDIN based on the count from the counter 124, and outputs the total number of horizontal pixels HT to the adjustment circuit 123. Instead, the adjustment circuit 123 may include the counter 124, and the adjustment circuit 123 may measure the total number of horizontal pixels HT.

The adjustment circuit 123 includes a counter 125, which counts the pixel clock signal CKPQ. The adjustment circuit 123 controls the buffering performed by the speed difference absorbing buffer circuit 122 and outputs the timing control information on the output timing of the output image data PDQ1 to PDQ3 based on the count measured by the counter 125 and the total number of horizontal pixels HT from the image data dividing circuit 121.

Specifically, the adjustment circuit 123 outputs the image data PDQ1' to PDQ3' from the image data dividing circuit 121 or the image data PDQ1' to PDQ3' buffered by the speed difference absorbing buffer circuit 122 to the output interface circuit 130 as the output image data PDQ1 to PDQ3. In this process, the adjustment circuit 123 determines the total numbers of horizontal pixels HT1 to HT3 in the output image data PDQ1 to PDQ3 based on the total number of horizontal pixels HT in the input image data PDIN. The adjustment circuit 123 controls the output timing of the output image data PDQ1 to PDQ3 based on the determined total numbers of horizontal pixels HT1 to HT3, the numbers of horizontal active pixels HA1 to HA3, and the horizontal front porch period. The numbers of horizontal active pixels HA1 to HA3 and the horizontal front porch period may be set, for example, by register settings.

Figure 16:
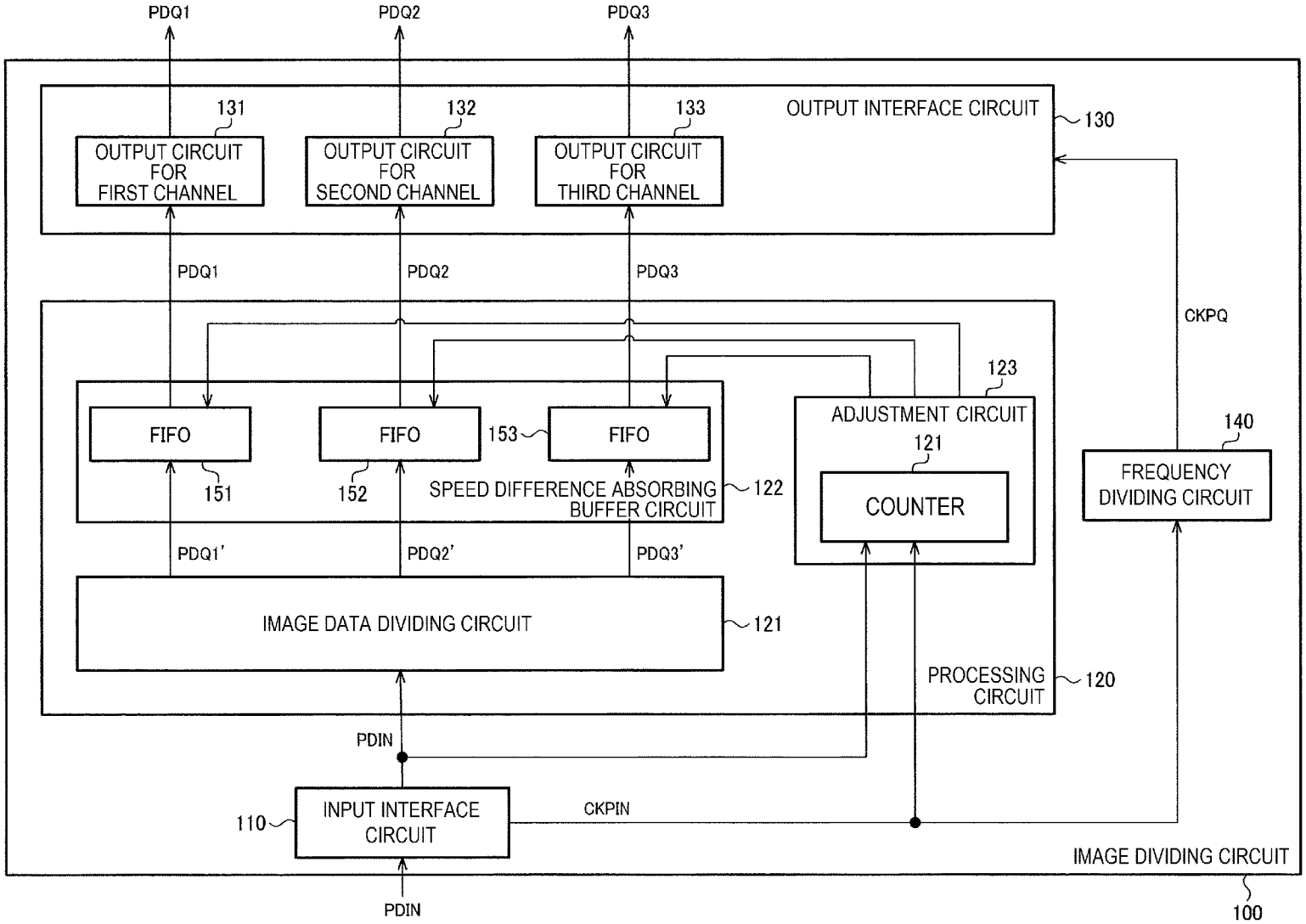
FIG. 16 shows an example of a third detailed configuration of the image dividing circuit.

FIG. 16 shows an example of a third detailed configuration of the image dividing circuit 100. In the example of the third detailed configuration, the speed difference absorbing buffer circuit 122 is formed of a FIFO. FIFO is an abbreviation for first in first out. The same components as those in FIG. 1, 14, or 15 will not be described as appropriate.

The adjustment circuit 123 includes the counter 124, which counts the pixel clock signal CKPIN. The adjustment circuit 123 measures the total number of horizontal pixels HT in the input image data PDIN, controls the buffering performed by the speed difference absorbing buffer circuit 122, and outputs the timing control information on the output timing of the output image data PDQ1 to PDQ3 based on the count measured by the counter 124.

Specifically, the speed difference absorbing buffer circuit 122 includes FIFOs 151 to 153. The image data dividing circuit 121 holds the input image data PDIN corresponding to one line, divides the held input image data PDIN into the image data PDQ1' to PDQ3' by using the method described with reference to FIG. 2, and outputs the image data PDQ1' to PDQ3' to the FIFOs 151 to 153. The FIFOs 151 to 153 buffer the image data PDQ1' to PDQ3', respectively.

In this process, the adjustment circuit 123 determines the total numbers of horizontal pixels HT1 to HT3 in the output image data PDQ1 to PDQ3 based on the total number of horizontal pixels HT contained in the input image data PDIN and measured by using the counter 124. The adjustment circuit 123 controls the timing at which the output image data PDQ1 to PDQ3 are read from the FIFOs 151 to 153, that is, the output timing of the output image data PDQ1 to PDQ3 based on the determined total numbers of horizontal pixels HT1 to HT3, the numbers of horizontal active pixels HA1 to HA3, and the horizontal front porch period. The numbers of horizontal active pixels HA1 to HA3 and the horizontal front porch period may be set, for example, by register settings.

Figure 17:
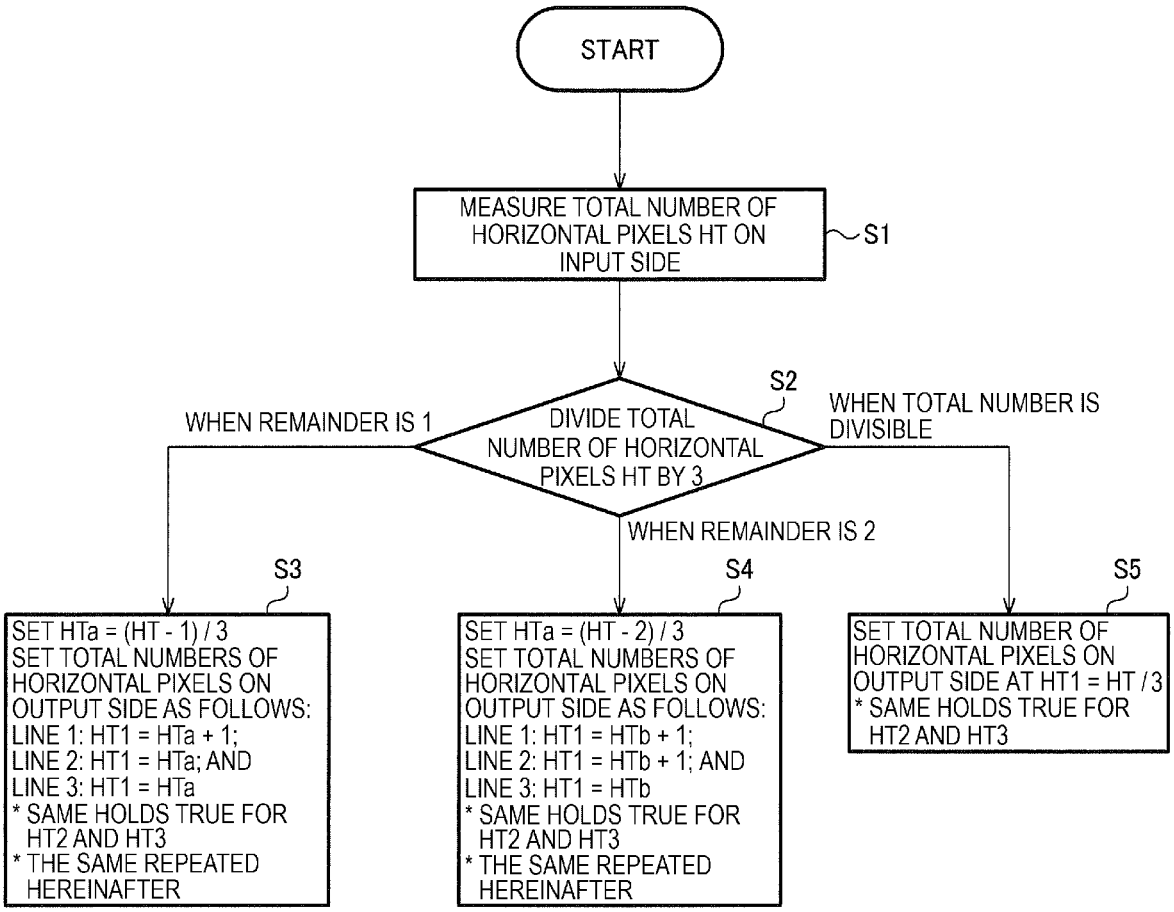
FIG. 17 is a flowchart showing the procedure of processes in the first method.

FIG. 17 is a flowchart showing the procedure of processes in the first method described above. In the following description, the primary element that carries out the process in each step is assumed to be the processing circuit 120 and can be switched to the adjustment circuit 123, the image data dividing circuit 121, or the speed difference absorbing buffer circuit 122 in accordance with the contents described in the examples of the first to third detailed configurations. The primary element may be changed even in the same step in the examples of the first to third detailed configurations in accordance with the contents thereof.

In step S1, the processing circuit 120 measures the total number of horizontal pixels HT on the input side. The processing circuit 120 measures the interval between the horizontal sync signals by using the counter 124 to measure the total number of horizontal pixels HT. In step S2, the processing circuit 120 divides the total number of horizontal pixels HT by 3 to determine the remainder.

When the remainder is 1 in step S2, the processing circuit 120 determines in step S3 HTa=(HT−1)/3, sets the total numbers of horizontal pixels in the first, second, and third lines in the first channel at HT1=HTa+1, HTa, HTa, and outputs the output image data PDQ1 configured by the thus set total numbers of horizontal pixels HT1 to the output circuit 131 for a first channel. Specifically, the processing circuit 120 sets, in the total number of horizontal pixels HT1, the interval between the horizontal sync signal indicating the start of a line and the horizontal sync signal indicating the end of the line. The processing circuit 120 outputs the output image data PDQ1 configured by the number of horizontally active pixels after the horizontal front porch period elapses from the timing of the horizontal synch signal indicating the start of the line. The total numbers of horizontal pixels HT2 and HT3 in the second and third channels are also set in the same manner. The same process is repeated for the fourth line and the following lines. FIG. 6 shows an example corresponding to step S3, and the total numbers of horizontal pixels in the first, second, and third lines are set at HT1=HTa, HTa, and HTa+1. An arbitrary one line of the first to third lines may be configured by the total number of horizontal pixels HTa+1.

When the remainder is 2 in step S2, the processing circuit 120 determines in step S4 HTb=(HT−2)/3, sets the total numbers of horizontal pixels in the first, second, and third lines in the first channel at HT1=HTb+1, HTb+1, HTb, and outputs the output image data PDQ1 configured by the total numbers of horizontal pixels HT1 to the output circuit 131 for a first channel. The total numbers of horizontal pixels HT2 and HT3 in the second and third channels are also set in the same manner. The same process is repeated for the fourth line and the following lines. Arbitrary two lines of the first to third lines may each be configured by the total number of horizontal pixels HTb+1.

When HT is divisible by 3 in step S2, the processing circuit 120 sets in step S5 the total number of horizontal pixels in every line in the first channel at HT1=HT/3 and outputs the output image data PDQ1 configured by the total number of horizontal pixels HT1 to the output circuit 131 for a first channel. The total numbers of horizontal pixels HT2 and HT3 in the second and third channels are also set in the same manner.

Figure 18:
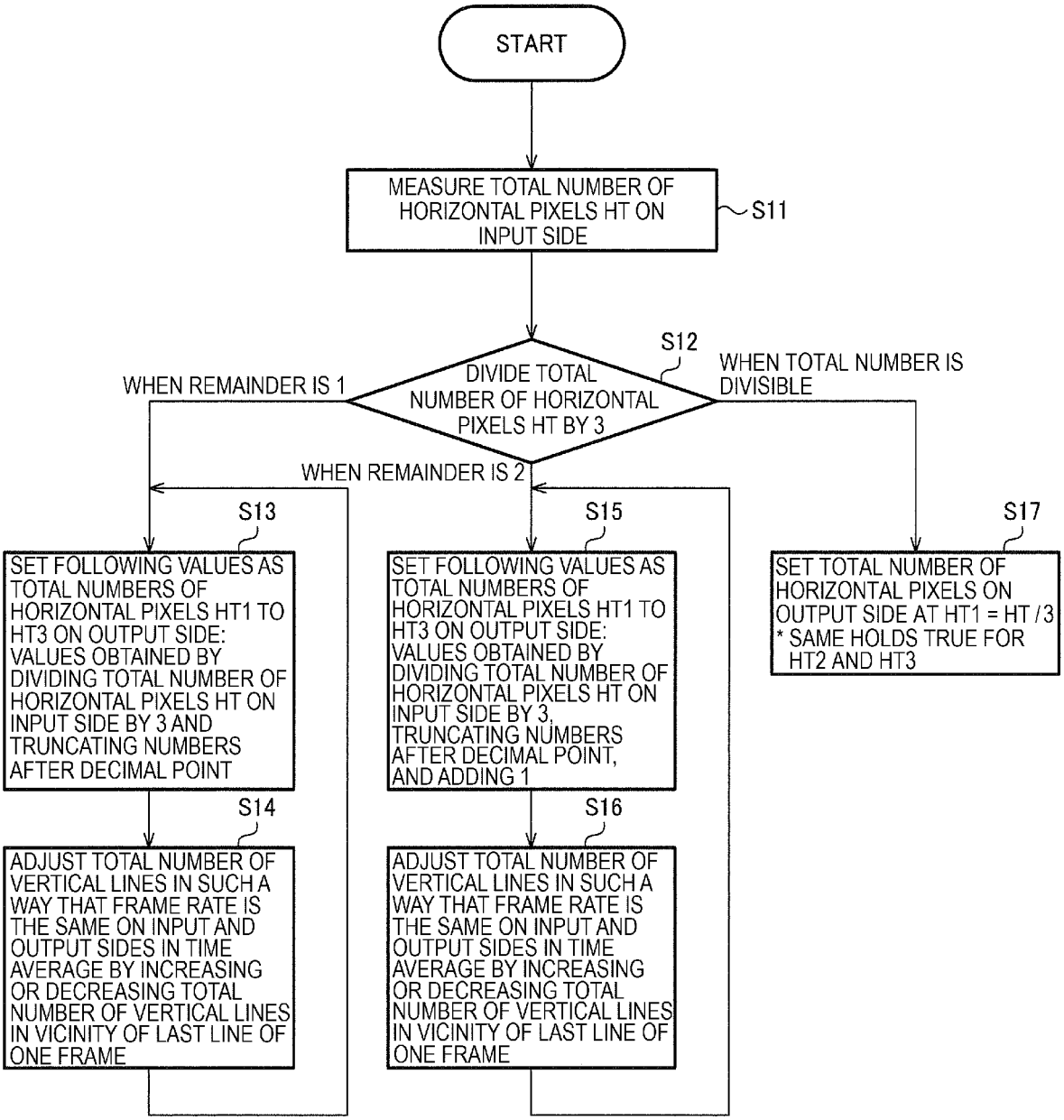
FIG. 18 is a flowchart showing the procedure of processes in the second method.

FIG. 18 is a flowchart showing the procedure of processes in the second method described above. In step S11, the processing circuit 120 measures the total number of horizontal pixels HT on the input side. In step S12, the processing circuit 120 divides the total number of horizontal pixels HT by 3 to determine the remainder.

When the remainder is 1 in step S12, the processing circuit 120 divides in step S13 the total number of horizontal pixels HT on the input side by 3 and sets the resultant values so rounded that the numbers after the decimal point are truncated as the total numbers of horizontal pixels HT1 to HT3 in every line in the first to third channels. In step S14, the processing circuit 120 adjusts the total number of vertical lines in the vicinity of the last line of one frame on the output side in such a way that the frame rates is the same in the time average on the input and output sides. There are a variety of methods for adjusting the total number of vertical lines. As an example, when the frame on the output side ends earlier than the frame on the input side, the processing circuit 120 increases the total number of vertical lines on the output side by one line in the next frame. When the frame on the output side ends later than the frame on the input side, the processing circuit 120 decreases the total number of vertical lines on the output side by one line in the next frame. In FIG. 8, the total number of vertical lines on the output side is increased by one line in the frame 2 because the frame on the output side ends earlier by 1125 pixels than the frame on the input side in the frame 1.

When the remainder is 2 in step S12, the processing circuit 120 divides in step S15 the total number of horizontal pixels by 3 and sets the resultant values so rounded that the numbers after the decimal point are truncated and incremented by 1 as the total numbers of horizontal pixels HT1 to HT3 in every line in the first to third channels. Step S16 is the same as step S14.

When HT is divisible by 3 in step S12, the processing circuit 120 sets in step S17 the total number of horizontal pixels in every line in the first to third channels at HT1=HT2=HT3=HT/3.

Figure 19:
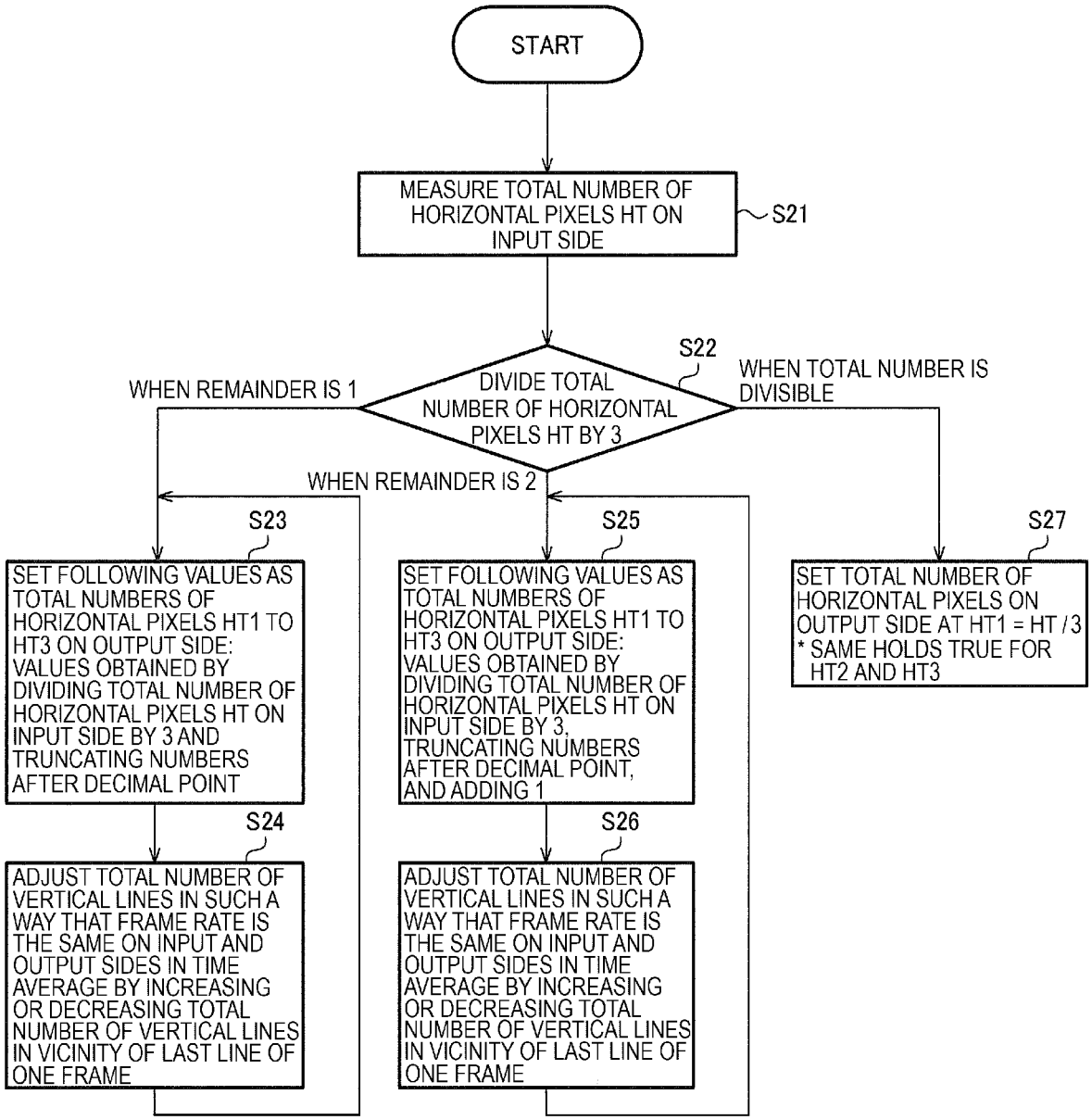
FIG. 19 is a flowchart showing the procedure of processes in the third method.

FIG. 19 is a flowchart showing the procedure of processes in the third method described above. In step S21, the processing circuit 120 measures the total number of horizontal pixels HT on the input side. In step S22, the processing circuit 120 divides the total number of horizontal pixels HT by 3 to determine the remainder.

When the remainder is 1 in step S22, the processing circuit 120 divides in step S23 the total number of horizontal pixels HT on the input side by 3 and sets the resultant values so rounded that the numbers after the decimal point are truncated as the total numbers of horizontal pixels HT1 to HT3 in the first to third channels. The processing circuit 120 sets the total number of horizontal pixels in lines of a frame from the first line to a line in the vicinity of the last line. In step S24, the processing circuit 120 adjusts the total number of horizontal lines in the vicinity of the last line of one frame on the output side in such a way that the frame rate is the same in the time average on the input and output sides. The meaning of the term "vicinity" is as follows: When the total number of horizontal pixels in the last line increases, only the total number of horizontal pixels in the last line is adjusted. In the case where the total number of horizontal pixels in the vicinity of the last line decreases, and when the amount of decrease is smaller than one line, only the total number of horizontal pixels in the last line is adjusted, whereas when the amount of decrease is greater than or equal to one line but smaller than two lines, the last line is deleted and the total number of horizontal pixels in the line immediately before the last line is adjusted. In the following examples, the number of lines to be deleted increases as the amount of decrease increases. FIG. 10 shows a case where the total number of horizontal pixels in the last line is increased, and only the total number of horizontal pixels in the last line is adjusted from 733 to 1108.

When the remainder is 2 in step S22, the processing circuit 120 divides in step S25 the total number of horizontal pixels by 3 and sets the resultant values so rounded that the numbers after the decimal point are truncated and incremented by 1 as the total numbers of horizontal pixels HT1 to HT3 in every line in the first to third channels. Step S26 is the same as step S24.

When HT is divisible by 3 in step S22, the processing circuit 120 sets in step S27 the total number of horizontal pixels in every line in the first to third channels at HT1=HT2=HT3=HT/3.

Figure 20:
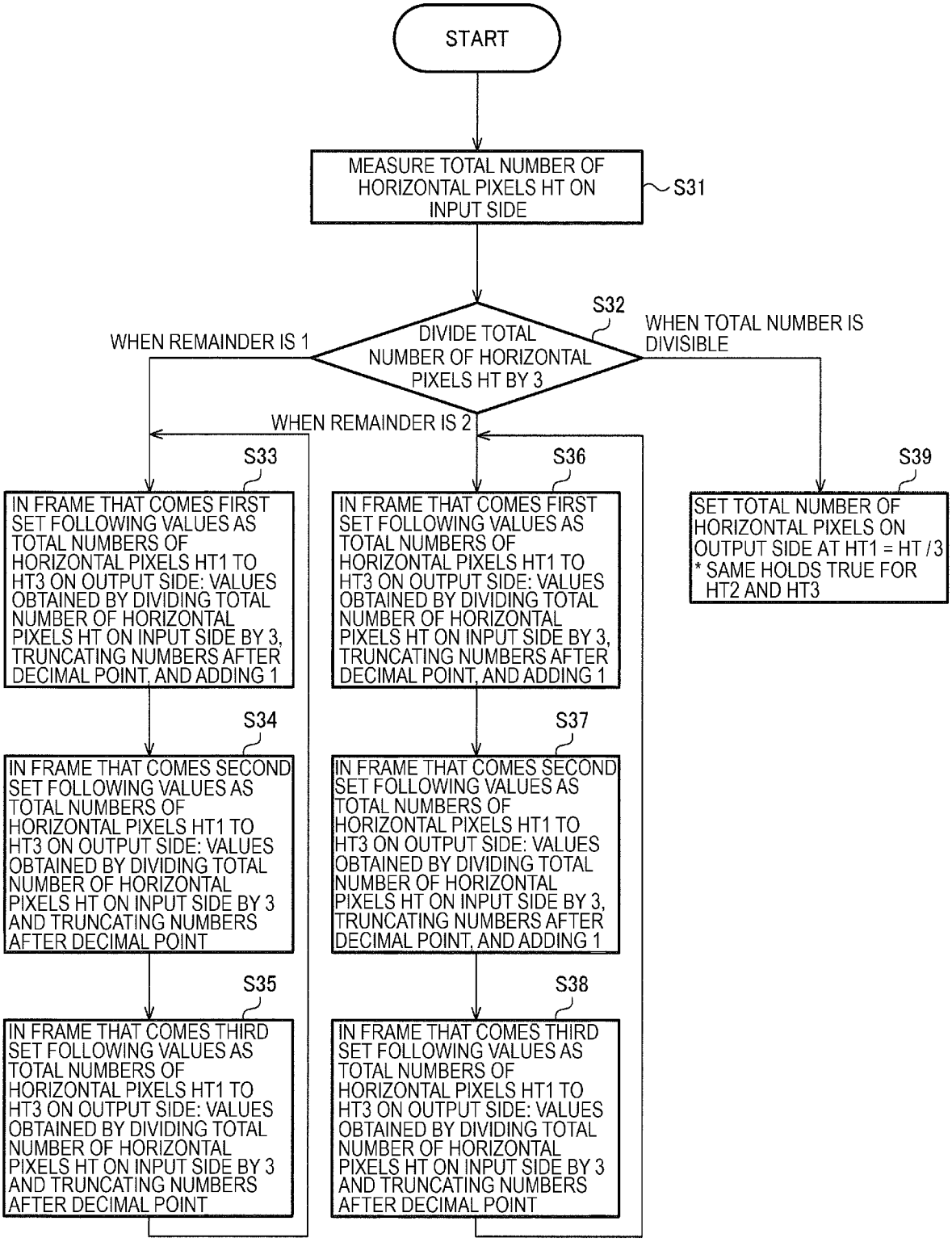
FIG. 20 is a flowchart showing the procedure of processes in the fourth method.

FIG. 20 is a flowchart showing the procedure of processes in the fourth method described above. In step S31, the processing circuit 120 measures the total number of horizontal pixels HT on the input side. In step S32, the processing circuit 120 divides the total number of horizontal pixels HT by 3 to determine the remainder.

When the remainder is 1 in step S32, the processing circuit 120 divides in step S33 the total number of horizontal pixels HT by 3 and sets the resultant values so rounded that the numbers after the decimal point are truncated and incremented by 1 as the total numbers of horizontal pixels HT1 to HT3 in the frame that comes first in the first to third channels. Let HTc be the value obtained by dividing the total number of horizontal pixels HT on the input side by 3 and truncating the numbers after the decimal point. In the frame that comes first, HT1=HT2=HT3=HTc+1 is satisfied. In step S34, the processing circuit 120 sets the total number of horizontal pixels in the frame that comes second at HT1=HT2=HT3=HTc. In step S35, the processing circuit 120 sets the total number of horizontal pixels in the frame that comes third at HT1=HT2=HT3=HTc. In the frame that comes fourth and the following frames, steps S33 to S35 are similarly repeated. FIG. 12 shows an example corresponding to steps S32 to S34, in which the total numbers of horizontal pixels in the frames 1 to 3 are set at HT1=HTc, HTc, and HTc+1, respectively. An arbitrary one frame of the frames 1 to 3 may be configured by the total number of horizontal pixels HTc+1.

When the remainder is 2 in step S32, the processing circuit 120 sets in step S36 the total number of horizontal pixels in the frame that comes first at HT1=HT2=HT3=HTc+1. In step S37, the processing circuit 120 sets the total number of horizontal pixels in the frame that comes second at HT1=HT2=HT3=HTc+1. In step S38, the processing circuit 120 sets the total number of horizontal pixels in the frame that comes third at HT1=HT2=HT3=HTc. In the frame that comes fourth and the following frames, steps S36 to S38 are similarly repeated. Arbitrary two frames of the frames 1 to 3 may be configured by the total number of horizontal pixels HTc+1.

When HT is divisible by 3 in step S32, the processing circuit 120 sets in step S39 the total number of horizontal pixels in every line in the first to third channels at HT1=HT2=HT3=HT/3.

Figure 21:
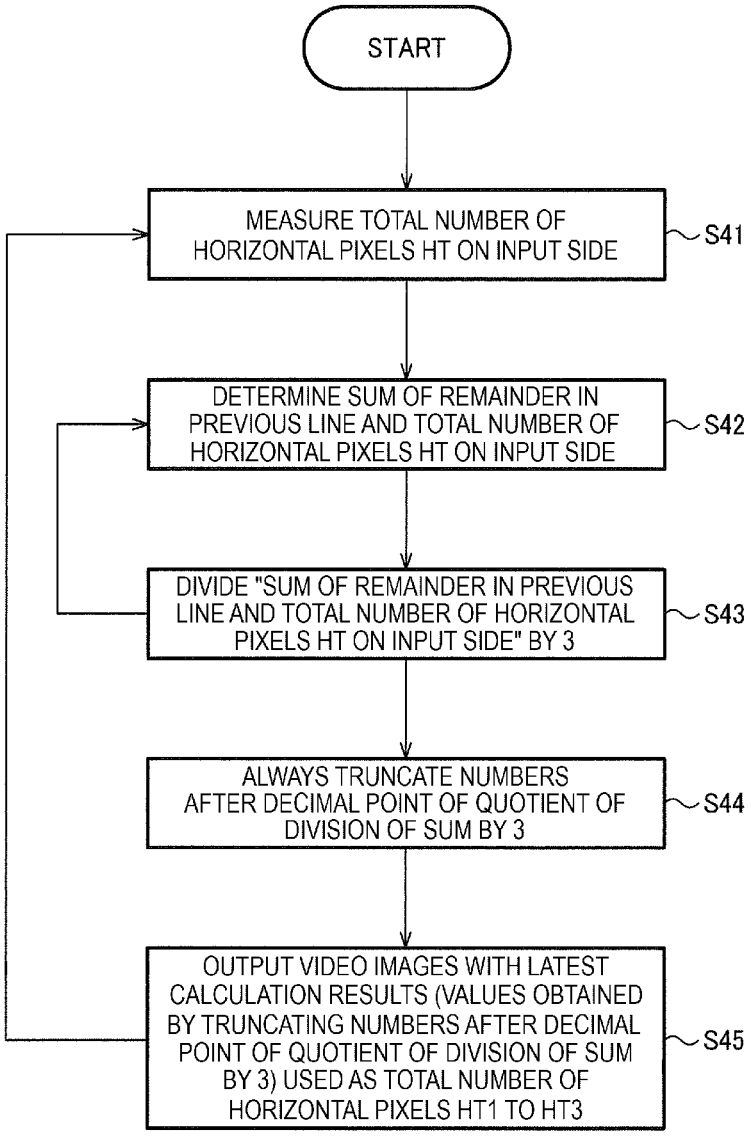
FIG. 21 is a flowchart showing the procedure of processes in the fifth method.

FIG. 21 is a flowchart showing the procedure of processes in the fifth method described above. In step S41, the processing circuit 120 measures the total number of horizontal pixels HT on the input side.

In step S42, the processing circuit 120 determines the sum of the remainder in the previous line and the total number of horizontal pixels HT. It is, however, noted that there is no previous line in the frame 1 after the apparatus is powered on, so that the remainder is set at 0. In the frame 2 and the following frames, the remainder is calculated. In step S43, the processing circuit 120 divides the sum described above by 3 to determine the remainder. The remainder is used in step S42 in the next line. In step S44, the processing circuit 120 truncates the numbers after the decimal point of the quotient of the division of the sum described above by 3 and sets the resultant values as the total numbers of horizontal pixels HT1 to HT3 on the output side. In step S45, the processing circuit 120 outputs the output image data PDQ1 to PDQ3 configured by the set total numbers of horizontal pixels HT1 to HT3 to the output circuits 131 to 133 for first to third channels. Steps S41 to S45 are then repeated.

For example, the total number of horizontal pixels in the first and second lines on the input side are set at HT=2200 and 2150. In the first line, dividing HT=2200 by 3 results in 733 and the remainder of 1. The total numbers of horizontal pixels on the output side are therefore HT1=HT2=HT3=733, and the remainder 1 is carried over to the second line. In the second line, HT+1=2251 divided by 3 results in 717 and the remainder of 0, so that the total numbers of horizontal pixels on the output side are HT1=HT2=HT3=717. It is noted that how to achieve the fifth method is not limited to the procedure in FIG. 21 as long as the total numbers of horizontal pixels HT1 to HT3 only need to be so controlled that the frame rate is the same on the input and output sides. For example, the total numbers of horizontal pixels in the first and second lines on the output side may be set at 734 and 716, respectively, as shown in FIG. 13.

The image dividing circuit according to the present embodiment described above includes the input interface circuit, the image data dividing circuit, and the output interface circuit. The input interface circuit receives input image data configured by the total number of horizontal pixels HT and the total number of vertical lines VT. The image data dividing circuit divides the input image data into first to n-th output image data for first to n-th channels. The output interface circuit includes output circuits for first to n-th channels that output the first to n-th output image data. The parameter n is an integer greater than or equal to 3, and HT is not an integer multiple of n. The output circuit for an i-th channel out of the output circuits for first to n-th channels outputs, out of the first to n-th output image data, i-th output image data in which at least one of the total number of horizontal pixels and the total number of vertical lines in the i-th channel out of the first to n-th channels has been variably adjusted. The parameter i is an integer greater than or equal to 1 but smaller than or equal to n.

According to the present embodiment, even when the total number of horizontal pixels HT on the input side is not an integer multiple of n, the frame rate can be the same in the time average on the input and output sides by variably adjusting at least one of the total number of horizontal pixels and the total number of vertical lines in the i-th channel. The data input rate at which data is inputted to the input interface circuit thus coincides in the time average with the data output rate at which data is outputted from the output interface circuit, whereby display errors can be avoided.

In the present embodiment, the input interface circuit may output a first clock signal that is a pixel clock signal for the input image data and the received input image data. The output circuits for first to n-th channels may output the first to n-th output image data by using a pixel clock signal that is a second clock signal having a frequency that is 1/n of the frequency of the first clock signal.

According to the present embodiment, at least one of the total number of horizontal pixels and the total number of vertical lines in the i-th channel is variably adjusted, whereby the data output rate per output channel can be 1/n of the data input rate in the time average. The data output rate thus coincides with the data input rate in the n channels as a whole, whereby the frame rate can be the same on the input and output sides.

The circuit device according to the present embodiment may further include a frequency dividing circuit. The frequency dividing circuit may divide the frequency of the first clock signal by n and output the resultant second clock signal.

According to the present embodiment, the frequency of the first clock signal, which is the pixel clock signal on the input side, is multiplied by 1/n, and the second clock signal is inputted as the pixel clock signal on the output side to the output circuits for first to n-th channels. In the present embodiment, the data output rate per output channel can be set at 1/n of the data input rate in the time average, whereby the frame rate can be the same on the input and output sides in the data input/output operation using the first and second clock signals described above.

In the present embodiment, the output circuit for an i-th channel may output i-th output image data in which at least one of the total number of horizontal pixels and the total number of vertical lines in the i-th channel has been so variably adjusted that the time average of the total number of pixels including the blanking period in the i-th channel is (HT×VT/n).

Let HTi be the total numbers of horizontal pixels on the output side, and VTQ be the total number of vertical lines on the output side. Under the definitions described above, the total number of pixels on the input side is HT×VT, and the total number of pixels on the output side is HTi×VTQ. According to the present embodiment, at least one of the total number of horizontal pixels and the total number of vertical lines is variably adjusted, so that HTi×VTQ=(HT×VT)/n is derived in the time average. The total number of pixels corresponds to the frame length, and when HTi×VTQ=(HT×VT)/n is satisfied in the time average, the frame rate is the same on the input and output sides.

The circuit device according to the present embodiment may further include an adjustment circuit. The adjustment circuit may variably adjust at least one of the total number of horizontal pixels and the total number of vertical lines in the i-th channel.

According to the present embodiment, the adjustment circuit variably adjusts at least one of the total number of horizontal pixels and the total number of vertical lines in the i-th channel, whereby the output circuit for an i-th channel can output i-th output image data in which at least one of the total number of horizontal pixels and the total number of vertical lines in the i-th channel has been variably adjusted.

The circuit device according to the present embodiment may further include a speed difference absorbing buffer circuit. The speed difference absorbing buffer circuit may absorb the difference between the data input rate at which data is inputted to the input interface circuit and the data output rate at which data is outputted from the output interface circuit.

In the present embodiment, the frame rate can be the same in the time average on the input and output sides, but there is a temporary difference between the data input rate and the data output rate. According to the present embodiment, the temporary difference between the data input rate and the data output rate is absorbed by the provided speed difference absorbing buffer circuit.

In the present embodiment, the adjustment circuit may adjust the total number of horizontal pixels in the i-th channel in such a way that the total number of horizontal pixels in a first line of one frame differs from the total number of horizontal pixels in a second line of the one frame.

According to the present embodiment, the total number of horizontal pixels in the i-th channel is so adjusted that lines configured by different total numbers of horizontal pixels are mixed with one another in one frame. The frame rate can thus be the same in the time average on the input and output sides.

In the present embodiment, the adjustment circuit may adjust the total number of horizontal pixels in such a way that the average of the total numbers of horizontal pixels in n×k lines in the i-th channel is HT/n. The parameter k is an integer greater than or equal to 1.

According to the present embodiment, the total numbers of horizontal pixels on the output side that are averaged over n×k lines is HT/n. The frame rate is thus the same in the time average on the input and output sides.

In the present embodiment described above, the adjustment circuit may set the total numbers of horizontal pixels in VT-s lines in one frame at a common setting value and set the total number of horizontal pixels in a specific s line at a value different from the setting value described above in the i-th channel. The parameter s is an integer greater than or equal to 1.

The difference between HT/n and the common setting value is accumulated for the VT-s lines. According to the present embodiment, the accumulated difference described above is canceled by setting the total number of horizontal pixels in the specific s line at a value different from the common setting value on the output side. The frame rate can thus be the same in the time average on the input and output sides.

In the present embodiment, the adjustment circuit may adjust the total number of vertical lines in the i-th channel in such a way that the total number of vertical lines in a first frame differs from the total number of vertical lines in a second frame.

If it is assumed that the total number of vertical lines on the output side is VT, the difference between HT/n and the total numbers of horizontal pixels on the output side is accumulated for the VT lines. According to the present embodiment, the accumulated difference described above is canceled by adjusting the total number of vertical lines on the output side in such a way that a plurality of frames configured by different total numbers of vertical lines are mixed with one another. The frame rate can thus be the same in the time average on the input and output sides.

In the present embodiment described above, the adjustment circuit may set the total number of horizontal pixels in a first frame at a first setting value and set the total number of horizontal pixels in a second frame at a second setting value different from the first setting value in the i-th channel.

According to the present embodiment, the total numbers of horizontal pixels on the output side are so adjusted that a plurality of frames configured by different total numbers of horizontal pixels are mixed with each other. The frame rate can thus be the same in the time average on the input and output sides.

In the present embodiment, the adjustment circuit may adjust the total number of horizontal pixels in such a way that the average of the total numbers of horizontal pixels in n×k frames in the i-th channel is HT/n. The parameter k is an integer greater than or equal to 1.

According to the present embodiment, the total numbers of horizontal pixels on the output side that are averaged over the n×k frames is HT/n. The frame rate is thus the same in the time average on the input and output sides.

An electro-optical apparatus according to the present embodiment includes the image dividing circuit described in any one of the aforementioned paragraphs, an electro-optical panel, and first to n-th display drivers that drive the electro-optical panel based on the first to n-th output image data outputted by the image dividing circuit.

The present embodiment has been described above in detail, and a person skilled in the art will readily appreciate that a large number of variations are conceivable to the extent that they do not substantially depart from the novel items and effects of the present disclosure. Such variations are all therefore assumed to fall within the scope of the present disclosure. For example, a term described at least once in the specification or the drawings along with a different term having a broader meaning or the same meaning can be replaced with the different term anywhere in the specification or the drawings. Furthermore, all combinations of the present embodiment and the variations fall within the scope of the present disclosure. The configurations, operations, and other factors of the input interface circuit, the processing circuit, the output interface circuit, the frequency dividing circuit, the image dividing circuit, the electro-optical panel, the display drivers, the electro-optical apparatus, the processing apparatus, the display system, and other components are not limited to those described in the present embodiment and can be changed in a variety of manners.

What is claimed is:

1. An image dividing circuit comprising:

an input interface circuit that receives input image data configured by a total number of horizontal pixels HT and a total number of vertical lines VT;

an image data dividing circuit that divides the input image data into first to n-th output image data for first to n-th channels; and an output interface circuit that includes output circuits for first to n-th channels that output the first to n-th output image data, wherein the parameter n is an integer greater than or equal to 3, and the parameter HT is not an integer multiple of the parameter n, an output circuit for an i-th channel (i is an integer greater than or equal to 1 but smaller than or equal to n) out of the output circuits for first to n-th channels outputs, out of the first to n-th output image data, i-th output image data in which at least one of the total number of horizontal pixels and the total number of vertical lines in the i-th channel out of the first to n-th channels is variably adjusted, the input interface circuit outputs a first clock signal that is a pixel clock signal for the input image data and the received input image data, and the output circuits for first to n-th channels output the first to n-th output image data by using a pixel clock signal that is a second clock signal having a frequency that is 1/n of a frequency of the first clock signal.

2. The image dividing circuit according to claim 1, further comprising a frequency dividing circuit that divides the frequency of the first clock signal by n and outputs the resultant second clock signal.

3. An image dividing circuit comprising:

an input interface circuit that receives input image data configured by a total number of horizontal pixels HT and a total number of vertical lines VT;

an image data dividing circuit that divides the input image data into first to n-th output image data for first to n-th channels; and an output interface circuit that includes output circuits for first to n-th channels that output the first to n-th output image data, wherein the parameter n is an integer greater than or equal to 3, and the parameter HT is not an integer multiple of the parameter n, an output circuit for an i-th channel (i is an integer greater than or equal to 1 but smaller than or equal to n) out of the output circuits for first to n-th channels outputs, out of the first to n-th output image data, i-th output image data in which at least one of the total number of horizontal pixels and the total number of vertical lines in the i-th channel out of the first to n-th channels is variably adjusted, and the output circuit for an i-th channel outputs the i-th output image data in which at least one of the total number of horizontal pixels and the total number of vertical lines in the i-th channel is so variably adjusted that a time average of the total number of pixels including a blanking period in the i-th channel is (HT×VT/n).

4. An image dividing circuit comprising:

an input interface circuit that receives input image data configured by a total number of horizontal pixels HT and a total number of vertical lines VT;

an image data dividing circuit that divides the input image data into first to n-th output image data for first to n-th channels;

an output interface circuit that includes output circuits for first to n-th channels that output the first to n-th output image data; and an adjustment circuit that variably adjusts at least one of the total number of horizontal pixels and the total number of vertical lines in the i-th channel, wherein the parameter n is an integer greater than or equal to 3, and the parameter HT is not an integer multiple of the parameter n, and an output circuit for an i-th channel (i is an integer greater than or equal to 1 but smaller than or equal to n) out of the output circuits for first to n-th channels outputs, out of the first to n-th output image data, i-th output image data in which at least one of the total number of horizontal pixels and the total number of vertical lines in the i-th channel out of the first to n-th channels is variably adjusted.

5. The image dividing circuit according to claim 4, further comprising a speed difference absorbing buffer circuit that absorbs a difference between a data input rate at which data is inputted to the input interface circuit and a data output rate at which data is outputted from the output interface circuit.

6. The image dividing circuit according to claim 4, wherein the adjustment circuit adjusts the total number of horizontal pixels in the i-th channel in such a way that the total number of horizontal pixels in a first line of one frame differs from the total number of horizontal pixels in a second line of the one frame.

7. The image dividing circuit according to claim 6, wherein the adjustment circuit adjusts the total number of horizontal pixels in such a way that an average of the total numbers of horizontal pixels in n×k lines (k is an integer greater than or equal to 1) in the i-th channel is HT/n.

8. The image dividing circuit according to claim 6, wherein the adjustment circuit sets the total numbers of horizontal pixels in VT−s lines (s is an integer greater than or equal to 1) in one frame at a common setting value and sets the total number of horizontal pixels in a specific s line at a value different from the setting value in the i-th channel.

9. The image dividing circuit according to claim 4, wherein the adjustment circuit adjusts the total number of vertical lines in the i-th channel in such a way that the total number of vertical lines in a first frame differs from the total number of vertical lines in a second frame.

10. The image dividing circuit according to claim 4, wherein the adjustment circuit sets the total number of horizontal pixels in a first frame at a first setting value and sets the total number of horizontal pixels in a second frame at a second setting value different from the first setting value in the i-th channel.

11. The image dividing circuit according to claim 10, wherein the adjustment circuit adjusts the total number of horizontal pixels in such a way that an average of the total numbers of horizontal pixels in n×k frames (k is an integer greater than or equal to 1) in the i-th channel is HT/n.

12. An electro-optical apparatus comprising:

the image dividing circuit according to claim 1;

an electro-optical panel; and first to n-th display drivers that drive the electro-optical panel based on the first to n-th output image data outputted by the image dividing circuit.

13. An electro-optical apparatus comprising:

the image dividing circuit according to claim 3;

an electro-optical panel; and first to n-th display drivers that drive the electro-optical panel based on the first to n-th output image data outputted by the image dividing circuit.

14. An electro-optical apparatus comprising:

the image dividing circuit according to claim 4;

an electro-optical panel; and first to n-th display drivers that drive the electro-optical panel based on the first to n-th output image data outputted by the image dividing circuit.

* * * * *